US012092417B2

(12) United States Patent
Spuhr

(10) Patent No.: US 12,092,417 B2
(45) Date of Patent: Sep. 17, 2024

(54) AUTOMATIC RIFLE AND RECEIVER FOR SAME

(71) Applicant: SPUHR I DALBY AB, Loddekopinge (SE)

(72) Inventor: Hakan Spuhr, Dalby (SE)

(73) Assignee: SPUHR I DALBY AB, Loddekopinge (SE)

( * ) Notice: Subject to any disclaimer, the term of this patent is extended or adjusted under 35 U.S.C. 154(b) by 0 days.

(21) Appl. No.: 16/502,731

(22) Filed: Jul. 3, 2019

(65) Prior Publication Data

US 2021/0003358 A1 Jan. 7, 2021

(51) Int. Cl.

| | |
|---|---|
| ***F41A 3/66*** | (2006.01) |
| ***F41A 19/10*** | (2006.01) |
| ***F41C 23/16*** | (2006.01) |
| ***F41C 23/20*** | (2006.01) |

(52) U.S. Cl.

CPC ..... *F41A 3/66* (2013.01); *F41A 19/10* (2013.01); *F41C 23/16* (2013.01); *F41C 23/20* (2013.01)

(58) Field of Classification Search

CPC .. F41A 3/66; F41A 11/00; F41A 11/02; F41A 11/04; F41A 19/10; F41C 23/16; F41C 23/20

USPC ..... 42/75.03

See application file for complete search history.

(56) References Cited

U.S. PATENT DOCUMENTS 2,290,778 A * 7/1942 Swebilius ..... F41A 3/64 42/17
2,548,622 A * 4/1951 Sampson ..... F41A 3/84 42/69.02
3,020,662 A * 2/1962 Merkel ..... F41A 3/18 42/11
3,380,182 A * 4/1968 Browning ..... F41C 23/00 42/75.03
3,969,980 A * 7/1976 Brandstatter ..... F41A 9/55 89/33.02
4,677,781 A * 7/1987 Lee ..... F41A 11/02 42/70.01
7,802,392 B2 * 9/2010 Peterson ..... F41A 11/02 42/75.03
8,484,877 B2 * 7/2013 Zimmerman ..... F41A 21/484 42/71.01

(Continued)

FOREIGN PATENT DOCUMENTS

WO 2009046456 A1 4/2009

OTHER PUBLICATIONS

Partial International Search Report on related PCT application (PCT/EP2020/068782) from International Searching Authority (EPO) dated Sep. 21, 2020.

(Continued)

*Primary Examiner* — Joshua E Freeman

*Assistant Examiner* — Benjamin S Gomberg

(74) *Attorney, Agent, or Firm* — Shore IP Group, PLLC; Howard J. Klein

(57) ABSTRACT

An automatic rifle (10) includes a receiver (12), a bolt assembly (110), a trigger mechanism (106), a buttstock assembly (100), a barrel assembly (104), and a grip assembly (102). The receiver (12) is characterized by being a unitary body that houses the bolt assembly (110) and the trigger mechanism (106), and the receiver (12) is configured for the connection thereto of the buttstock assembly (100), the barrel assembly (104), and the grip assembly (102).

17 Claims, 10 Drawing Sheets

(56) References Cited

U.S. PATENT DOCUMENTS

| | | | | |
|---|---|---|---|---|
| 9,395,146 | B2 * | 7/2016 | Tippmann, Jr. | F41B 11/722 |
| 9,441,899 | B2 * | 9/2016 | Micklethwaite | F41A 19/44 |
| 9,541,341 | B2 * | 1/2017 | Macy | F41A 19/16 |
| 9,638,484 | B1 * | 5/2017 | Friend | F41A 21/482 |
| 9,777,975 | B2 * | 10/2017 | Folkestad, II | F41A 3/66 |
| 2004/0091065 | A1 * | 5/2004 | Henttu | H04B 1/1027 375/317 |
| 2007/0033850 | A1 * | 2/2007 | Murello | F41C 23/16 42/71.01 |
| 2011/0209607 | A1 * | 9/2011 | St. George | F41A 19/10 89/191.01 |
| 2013/0212920 | A1 | 8/2013 | Law | |
| 2014/0091065 | A1 * | 4/2014 | Dumortier | F41A 3/66 219/121.64 |
| 2016/0033218 | A1 * | 2/2016 | Folkestad, II | F41A 3/66 42/2 |
| 2017/0198997 | A1 * | 7/2017 | Geissele | F41A 3/66 |
| 2019/0017773 | A1 * | 1/2019 | Myers | F41C 9/06 |
| 2019/0195595 | A1 * | 6/2019 | Kielsmeier | F41C 33/08 |
| 2019/0310037 | A1 * | 10/2019 | Barton | F41A 11/00 |

OTHER PUBLICATIONS

Forgotten Weapons: "H&K G36: Germany Adopts the 5.56mm Cartridge"; Dec. 28, 2018; pp. 1-9; XP054980884; Retrieved from the Internet: URL:https://www.youtube.com/watch?v=qQNsZ8Qbd8A; [retrieved on Sep. 10, 2020].

* cited by examiner

AUTOMATIC RIFLE AND RECEIVER FOR SAME

TECHNICAL FIELD

The proposed technology relates generally to automatic rifles. It relates specifically to receivers for automatic rifles. It further relates to AR-10 and AR-15 style automatic rifles.

BACKGROUND

There are a number of automatic rifles that have an upper and a lower receiver. For example, in the Colt AR-15 rifle the bolt assembly is housed in the upper receiver and the barrel assembly is attached at the front end of the upper receiver. Further, the buttstock assembly is attached at the rear end of the lower receiver, the trigger mechanism is housed in the lower receiver, and the grip assembly is attached to the lower end of the lower receiver. The safety mechanism is in part supported by the lower receiver and the grip assembly, and the magazine well is located in the lower receiver.

There can be a play between the upper receiver and the lower receiver of the automatic rifle. For example, it can result in a sideways wobble of the upper receiver relative to the lower receiver.

This can cause several problems. For example, the play can reduce the consistency in handling, in particular when shouldering the automatic rifle and if the barrel assembly and the buttstock assembly are attached to different receiver parts, such as for the Colt AR-15 rifle. Typically, the reduced consistency of the shooter negatively affects the shooting precision and accuracy.

The play can also cause a reduced precision in the mechanics of the automatic rifle, which can have a negative impact on the shooting precision. This effect is typically smaller than that of the reduced consistency in the handling.

An additional problem is that the play can cause the automatic rifle to rattle when handled. Such noise can be detrimental when operating under field conditions.

Object

The proposed technology aims at improving the precision and accuracy of automatic rifles. It further aims at obviating the aforementioned disadvantages of known automatic rifles, and at providing an automatic rifle without a play between an upper and a lower receiver. It is a specific object of the proposed technology to improve the precision and accuracy of automatic rifles based on the AR-10 and AR-15 platforms. However, it is understood that the proposed technology is not limited to these platforms.

SUMMARY

According to a first aspect of the proposed technology, one or more of the above objects are achieved by an automatic rifle comprising: a receiver, a bolt assembly, a trigger mechanism, a buttstock assembly, a barrel assembly, and a grip assembly. The receiver houses the bolt assembly and the trigger mechanism. Additionally, the buttstock assembly, the barrel assembly, and the grip assembly, are connected, or attached, to the receiver. The receiver is a unitary body.

In a second aspect of the proposed technology, a receiver for an automatic rifle is provided. The receiver is configured to house a bolt assembly and a trigger mechanism. The receiver is further adapted to connect to a buttstock assembly and a barrel assembly. The receiver is a unitary body.

The unitary body of the receiver has the effect that there is no play between an upper receiver and a lower receiver, which contributes to an improved precision and accuracy, in particular in comparison with systems having the buttstock assembly connected to a lower receiver and the barrel assembly and bolt assembly connected to the upper receiver, as is typically the case for rifles based on the AR-10 and AR-15 platforms.

In particular, the unitary body has the effect of a stiffer receiver that is less sensitive to deformations. The improved ability to withstand bending and torsion contributes to an improved precision and accuracy when shooting. The effect is particularly noticeable when changing from shooting without support to resting the front end of the automatic rifle on a support. For example, the automatic rifle can be provided with a bipod or a forend that rests on a horizontal support, which may cause the receiver to bend in a vertical direction. Additionally, the rifling of the barrel may result in a torque that is transferred to the receiver when shooting, which may cause a torsion of the receiver. This is reduced by the unitary body of the receiver. It should be noted that the improved stiffness resulting from the unitary body can be obtained without adding any significant amounts of material to the receiver. Only non-plastic deformations are discussed here, but it is understood that the unitary receiver also improves the ability to resist plastic deformations and other material failures.

The bolt assembly may be slidably supported by, or with respect to, the receiver. Similarly, the trigger mechanism may, at least in part, be supported by the receiver. The term "housing," as a verb, is here understood to encompass covering and enclosing.

The receiver is understood to be structural and not limited to only the functions of a receiver. A unitary body is here understood to encompass a body that is composed of a single piece. It may be formed as a single unit or piece, for example by welding two pieces together. It may be manufactured from a single piece of material. The term "manufactured" is here understood to encompass molding using a single mold and machining of a single piece of material. The latter includes milling, lathing, boring, sawing, and cutting. For example, the receiver may have been manufactured by machining a single piece of an aluminum alloy, i.e. an alloy in which aluminum is the predominant metal. Alternatively, the receiver may be formed by additive manufacturing, for example by using a metal 3D printer.

In other words, the unitary body cannot be dismantled without permanently changing the structure of the receiver. For example, smaller pieces may be formed by sawing or cutting the receiver, which will permanently change its structure.

The unitary body should not be interpreted as a monolithic structure having an upper receiver and a forend that constitutes a single piece of material. However, the proposed receiver may further have a forend forming part of the unitary body.

The buttstock assembly may be connected to the rear end of the receiver, and/or be positioned behind the bolt assembly. The barrel assembly may be connected to the front end of the receiver, and/or be positioned in front of the bolt assembly. The grip assembly may be positioned below the receiver, at a lower end of the receiver, and/or below the bolt assembly. The trigger mechanism may be positioned below the bolt assembly. The relative positions of the different components specified here contribute to an improved stiffness of the receiver in the vertical direction.

The receiver may have, or form, a magazine well arranged to receive a detachable magazine. Here, the magazine well is understood as the slot or space of the receiver in which the magazine is seated. The magazine well may be located below the bolt assembly and/or in front of the grip assembly. This relative position also contributes to an improved stiffness of the receiver in the vertical direction.

The magazine may be a box magazine. The automatic rifle may further comprise a magazine catch for releasably locking the magazine to the receiver. The magazine well may have a lower well opening, or a magazine opening, through which the magazine can be slidably removed in a downward motion, or slidably inserted in an upward motion.

The minimum height of the receiver at the magazine well may be in the range 80 mm to 140 mm, or in the range 90 mm to 120 mm, or approximately 100 mm. It is contemplated that these dimensions allow for a good balance between structural stiffness in the vertical direction and the amount of material required in the structure of the receiver. The dimensions specified here do not include any accessory rails at the upper end of the receiver. The minimum height of the receiver is here understood to encompass the minimum height of the receiver between the magazine opening and the top of the receiver at a right angle to the bore axis of the rifle.

An automatic rifle is here understood to encompass both semi-automatic and fully automatic rifles. The automatic rifle may be a locked breach automatic rifle. It is specified that the receiver houses the trigger mechanism, but it is understood that the trigger extends from the receiver.

Further optional technical details of the different aspects of the proposed technology are described below.

The automatic rifle may be gas operated. It may be operated by direct impingement. Alternatively, it may operate by a piston, for example a short-stroke piston or a long-stroke piston. Here, the AR-10 and AR-15 types of automatic rifles are considered as operating by direct impingement, even though the bolt assembly of these rifle types has a piston action.

The bolt assembly may comprise: a bolt, a bolt carrier, and a firing pin. The receiver may have, or form, a rear opening (at its rear end) through which the bolt assembly can be slidably removed in a backward motion. This way of removing the bolt assembly with the opening at the rear end of the receiver allows for a stiffer receiver that reduces the risk for a bending and torsion of the receiver.

The rear opening is understood to encompass an opening located at the rear end of the receiver. The backward motion is understood to be parallel to the cycling motion of the bolt carrier, or to the bore axis of the barrel.

The bolt may be a rotationally locked bolt. This means that the bolt rotationally locks to the barrel assembly, or more specifically a barrel extension of a barrel assembly, when a round is inserted in the firing chamber of the automatic rifle. This has the effect that essentially all forces generated at firing are contained by the bolt and the barrel assembly.

The buttstock assembly may comprise: a buffer, an action spring, and a buffer tube, or receiver extension, housing the buffer and the action spring. The buffer tube is arranged to receive a rear portion of the bolt carrier during a cycling of the bolt assembly. The buttstock assembly may further have a buttstock adapter attached to the buffer tube and to the receiver at the rear opening of the receiver. This way, the buttstock adapter connects the buffer tube to the receiver. The buttstock adapter has a bolt carrier opening through which the rear portion of the bolt carrier passes and enters the buffer tube during the cycling of the bolt assembly. The buttstock adapter further prevents the bolt assembly from being removed through the rear opening.

The buttstock adaptor may comprise an adaptor body forming the bolt carrier opening. The adaptor body is understood to be unitary; for example, it may be manufactured in a single piece by machining a piece of an aluminum alloy.

The buttstock adaptor may have a spring biased first locking pin with a truncated conical head. The first locking pin may be supported by the receiver and located at the rear end of the receiver. The adaptor body may have a first through bore aligned with the first locking pin in the closed orientation of the buttstock assembly. The first through bore may have a cylindrical portion at its front end. The conical head may have a base with a diameter that is greater than the diameter of the cylindrical portion, and its truncated tip may have a diameter that is smaller than the diameter of the cylindrical portion. The truncated tip enters the cylindrical portion of the first through bore and engages the adaptor body in the closed orientation of the buttstock assembly, thus locking the buttstock assembly in this orientation.

The bolt assembly may comprise a transversely protruding portion, or component. The protruding portion may be located at the upper end or side of the bolt carrier. For example, if the automatic rifle is operated by direct impingement, the bolt assembly may comprise a carrier key connected to the upper end of the bolt carrier, and gases from the gas tube, or gas conduit, enter an expansion chamber of the bolt assembly via the carrier key, such as with the Colt AR-15. Alternatively, if the automatic rifle is piston operated, the bolt assembly may comprise a bolt carrier appendix connected to the upper end of the bolt carrier and that cooperates with the piston, such as with the Heckler & Koch MR223.

The rear opening of the receiver may allow passage of the transversely protruding component, thus allowing removal of the complete bolt assembly. The bolt carrier opening of the buttstock adapter may prevent passage of the transversely protruding component, or the buttstock adapter may prevent the transversely protruding portion from passing the buttstock adapter, or from passing through the bolt carrier opening. In other words, the bolt assembly may have a transverse extension in a first direction that is greater than the transverse extension of the bolt carrier opening in the same first direction.

The buttstock adaptor may comprise a buffer retainer preventing the buffer from entering the receiver, or leaving the buffer tube, through the bolt carrier opening. The buffer retainer may be spring biased with respect to and supported by the buttstock adaptor, or more specifically by the adaptor body of the buttstock adaptor. The buffer retainer may be positioned in front of the bolt carrier opening. This has the advantage that the buffer will be retained in the buffer tube even when the buttstock assembly is removed from the receiver.

The bolt carrier opening of the buttstock adapter may be a through hole and have a female threading, the buffer tube may have a front portion positioned in the bolt carrier opening, and the front portion may have a male threading that cooperates with the female threading of the bolt carrier opening.

The buttstock assembly may further have a rotation locker, or nut, positioned on the front portion of the buffer tube and cooperating with the male threading of the front portion, wherein the rotation locker presses against the buttstock adapter, and/or fixes the buffer tube relative to the buttstock adaptor.

The buttstock adaptor may be releasably attached to the receiver. This has the effect that the buttstock assembly as a whole is releasably attached to the receiver. Here, "releasably attached" is understood as meaning the buttstock adaptor can be detached from the receiver in a field stripping.

The buttstock adaptor may further comprise a first pivot, or a first hinge, rotationally connecting the buttstock assembly to the receiver. The buttstock assembly may have a closed orientation relative to the receiver at which the bolt carrier opening is aligned with the rear opening of the receiver. The buttstock assembly may further have an open orientation at which the buttstock adapter allows the bolt assembly to be removed through the rear opening.

It is understood that the buttstock assembly is connected to the receiver in the open orientation of the buttstock assembly. A first pivot may be attached to the buttstock adaptor, or to the adaptor body of the buttstock adaptor, and connects the buttstock adaptor to the receiver. The buttstock assembly may be releasably locked to the receiver in the closed orientation. Similarly, the buttstock assembly may be releasably locked to the receiver in the open orientation.

The first pivot may engage the receiver at a point below the rear opening of the receiver. The point may be at the rear opening. This allows for a charging handle engaging the upper end of the bolt assembly to extend backwards.

The first pivot may be arranged to rotate the buttstock assembly around a longitudinal axis, around an axis that is parallel to the cycling motion of the bolt carrier, or around an axis that is parallel to the bore axis of the barrel. It has the effect that the shape or dimensions of the automatic rifle do not significantly change when changing the orientation of the buttstock adaptor from closed to open.

Here, the adaptor body of the buttstock adaptor may form the first pivot. This means that the first pivot is an integral part of the adaptor body.

The buttstock adaptor may comprise a first adaptor flange and the receiver may comprise a first receiver flange, wherein the first adaptor flange engages the first receiver flange (only) in the closed orientation of the buttstock assembly and prevents the buttstock assembly from moving backwards relative to the receiver. Similarly, the buttstock adaptor may comprise a second adaptor flange and the receiver may comprise a second receiver flange, wherein the second adaptor flange engages the second receiver flange (only) in the closed orientation of the buttstock assembly and prevents the buttstock assembly from moving backwards relative to the receiver. The adaptor body of the buttstock adaptor may form the first adaptor flange and the second adaptor flange. Similarly, the receiver may form the first receiver flange and the second receiver flange.

The first adaptor flange may have a first rim and the second adaptor flange may have a second rim, and the first rim and the second rim of the adaptor flanges may extend in the same general direction and/or face in the same general direction. Similarly, the first receiver flange may have a first rim and the second receiver flange may have a second rim, and the first rim and the second rim of the receiver flanges may extend in the same general direction and/or face in the same general direction. The rim of the first adaptor flange and the rim of the first receiver flange may face in opposite directions. Similarly, the rim of the second adaptor flange and the rim of the second receiver flange may face in opposite directions.

The first receiver flange may be located at the rear opening of the receiver. Similarly, the second receiver flange may be located at the rear opening of the receiver. The first receiver flange and the second receiver flange may be located on opposite sides of the rear opening, or at opposite sides of the receiver. The first receiver flange and the second receiver flange may be located above the first pivot of the buttstock adaptor.

The flange arrangements described here allow for a releasable locking of the buttstock assembly that is rigid and with little or no play between the buttstock assembly and the receiver.

The first pivot of the buttstock adaptor may comprise a pivot flange and the receiver may comprise a third receiver flange, wherein the pivot flange engages the third receiver flange in the closed orientation and in the open orientation of the buttstock assembly and prevents the buttstock assembly from moving backwards relative to the receiver. The buttstock assembly may further have a released orientation relative to the receiver in which the pivot flange is disengaged from the third receiver flange, and the buttstock assembly can be removed, or is released, from the receiver. The adaptor body of the buttstock adaptor may form the pivot flange. The receiver may form the third receiver flange.

It is understood that the first and second adaptor flanges are disengaged from the first and second receiver flanges, respectively, in the open orientation of the buttstock assembly.

The orientation of the buttstock assembly relative to the receiver may be changed from the closed orientation to the open orientation by a rotation around the first pivot in a second direction, and from the open orientation to the released orientation by a rotation around the first pivot in the same second direction.

The first pivot may be arranged to rotate the buttstock assembly around a transverse axis, around an axis that is transverse to the cycling motion of the bolt carrier, or around an axis that is transverse to the bore axis of the barrel. The receiver may have two opposed sides (left and right) and the transverse axis may extend between the opposed sides. The transverse axis may be horizontal with the automatic rifle oriented with the grip assembly located directly below the receiver or the bolt assembly.

The grip assembly may form part of the buttstock adapter, and the first pivot may be located on, or connect to, the grip assembly. The grip assembly and the buttstock adaptor may form a rigid structure, or a rigid beam. The first pivot may be located at the front of the grip assembly and connect to the receiver at the rear of the magazine well. Additionally, or alternatively, the grip assembly and the buttstock assembly may jointly form a thumbhole stock.

The trigger mechanism may comprise: a trigger, a hammer operationally connected to the trigger, and a housing supporting the trigger and the hammer. The receiver may have, or may form, a trigger housing seat in which the housing of the trigger mechanism is positioned. The trigger mechanism is releasably connected to the receiver, and the trigger housing seat has a lower seat opening, or trigger opening, through which the housing can be slidably removed in a downward motion, or slidably inserted in an upward direction.

The minimum height of the receiver at the trigger housing seat may be in the range 65 mm to 135 mm, or in the range 75 mm to 105 mm, or approximately 85 mm. It is contemplated that these dimensions allow for a good balance between structural stiffness in the vertical direction and the amount of material required in the structure of the receiver.

The dimensions specified here do not include any accessory rails at the upper end of the receiver. The minimum height of the receiver is here understood to encompass the minimum height of the receiver between the trigger opening and the top of the receiver at a right angle to the bore axis of the rifle. This contributes to a stiffer receiver structure.

It is understood that the trigger mechanism has a trigger spring biasing the trigger and a hammer spring biasing the hammer. The trigger mechanism may also have a disconnector.

The trigger may be rotationally connected to the housing by a hollow trigger pin. Similarly, the hammer may be rotationally connected to the housing by a hollow hammer pin. The receiver may further have a first pin hole and a second pin hole, both extending from its outside to the trigger housing seat. The trigger mechanism may then further comprise an inner trigger pin inserted in the first pin hole and in the hollow trigger pin. Similarly, the trigger mechanism may further comprise an inner hammer pin inserted in the second pin hole and in the hollow hammer pin. This way, the housing is locked to the receiver, and the movement of the trigger and the hammer is defined relative to the receiver, which contributes to an improved accuracy in the trigger mechanism.

The trigger mechanism may comprise a pin assembly comprising the inner trigger pin, the inner hammer pin, and a rigid support, or beam, rigidly connecting the inner trigger pin and the inner hammer pin.

The grip assembly may be releasably attached to the receiver and the grip assembly, and it prevents the housing of the trigger mechanism from being removed through the lower seat opening. Here, the grip assembly may, at least in part, block the lower seat opening of the receiver when attached to the receiver.

Additionally or alternatively, the grip assembly may comprise a second pivot, or second hinge, rotationally connecting the grip assembly to the receiver. The grip assembly may have a closed orientation relative to the receiver in which it prevents the housing of the trigger mechanism from being removed through the lower seat opening, and an open orientation relative to the receiver at which the grip assembly allows the housing of the trigger mechanism to be removed through the lower seat opening. In the closed orientation, the grip assembly may, at least in part, block the lower seat opening of the receiver.

The grip assembly may comprise a pistol grip. It may further comprise grip base forming a trigger guard rigidly attached to the pistol grip. This means that the trigger guard and the pistol grip form a rigid structure. The second pivot may connect the grip assembly to the receiver at the front, or a point at the front, of the trigger guard, or the grip base. The second pivot may connect to the receiver at the rear of the magazine well.

The grip assembly may comprise an upward extending portion that engages the pin assembly, or more precisely the rigid support, in the closed orientation of the grip assembly relative to the receiver. A portion of the pin assembly may be positioned between the upward extending portion and the receiver. This has the effect that the pin assembly is secured.

The automatic rifle may further comprise a safety mechanism. It may be positioned below the bolt assembly. Additionally or alternatively, the safety mechanism may, at least in part, be supported by the receiver.

The safety mechanism may comprise: a safety lever and a safety biasing mechanism. The safety biasing mechanism may comprise: a safety detent and a safety-detent spring operationally connected to the safety detent, whereby the safety detent biases the safety lever. The safety biasing mechanism as a whole is housed in the receiver. The safety-detent spring may be arranged to provide a pushing force in a downward direction. The safety biasing mechanism may further comprise: a detent lever pivotally supported relative to the receiver, whereby the safety-detent spring acts on the detent lever and the detent lever provides a pushing force in an upward direction that is transferred to the safety detent.

It is understood that the safety biasing mechanism is supported by the receiver. The safety-detent spring may be a compression coil spring oriented in a generally vertical direction, or transverse to the cycling motion of the bolt carrier, or transverse to the bore axis of the barrel.

It is further understood that the safety lever has a first setting and a second setting, wherein in the first setting the safety lever prevents the trigger mechanism from firing, and in the second setting the safety lever allows the trigger mechanism to fire a single shot when the trigger is engaged. The safety lever may operationally engage a disconnector if the trigger mechanism has this component. The safety lever has a first recess that receives the safety detent in the first setting and a second recess that receives the safety detent in the second setting, thus biasing the safety lever in the respective setting.

The safety mechanism may further have the function of a (fire) selector for selecting between semi-automatic fire and automatic fire. This means that the safety lever is a selector lever, the safety biasing mechanism is a selector biasing mechanism, the safety detent is a selector detent, and the safety-detent spring is a selector detent spring. The safety lever may have a third setting, wherein in the third setting the safety lever allows the trigger mechanism to fire automatically when the trigger is engaged. The safety lever then has a third recess that receives the safety detent in the third setting, thus biasing the safety lever in third setting.

The barrel assembly may comprise: a barrel and a barrel extension supporting the barrel. The receiver may have, or may form, an extension hole, or bore, at its front end. The barrel extension is at least in part positioned in the extension hole. The barrel assembly may further comprise: a forward extension fixed relative to the receiver at the front of the receiver. The forward extension has, or forms, a screw hole having a female threading. The barrel assembly may further have a barrel screw at least in part positioned in the screw hole and having a male threading cooperating with the female threading of the screw hole. The barrel screw engages the barrel extension and presses it against the receiver.

The forward extension and the barrel screw allow for greater material thickness of the receiver at the extension hole, which allows for a stiffer support or attachment of the barrel to the receiver.

The automatic rifle may comprise a forend attached to the forward extension. The forend may contact only the forward extension of the different parts of the barrel assembly. This has the effect that the support of the forend is effectively independent of the support of the barrel. The forend is not in direct contact with the barrel, the barrel extension, or the screw fixing the barrel extension. This contributes to an improved precision and accuracy.

The barrel screw may have a through bore and the barrel may extend through the through bore. The barrel screw may form a gap between itself and the barrel, which has the effect that the barrel is a fully free-floating barrel, which contributes to an improved precision and accuracy.

It is understood that the extension hole of the receiver has a shape that matches the shape of the barrel extension in the extension hole. Additionally, it is understood that the extension hole is a through bore. The extension hole of the receiver may have a (smooth) cylindrical shape. The barrel extension may have a cylindrical portion with a (smooth) cylindrical outer shape matching the cylindrical shape of the extension hole, wherein the cylindrical portion is positioned in the extension hole.

The forward extension may form a part of the receiver. That the forward extension forms a part of the receiver means that it is a part of the unitary body of the receiver, which means that it is permanently fixed to the rest of the receiver and cannot be removed therefrom without machining or breaking the receiver.

The combined length of the extension hole and the screw hole, or the length between the rear end of the screw hole to the front end of the forward extension, may be in the range 45 mm to 75 mm, or in the range 50 mm to 65 mm, or approximately 55 mm. It is contemplated that these dimensions allow for a stiffer structure of the receiver at the barrel assembly, which contributes to a more rigid connection and an improved precision and accuracy.

The forward extension may form an accessory rail of a rail-interface system, such as a Picatinny rail. The accessory rail may extend along the upper end of the receiver. It is understood that an accessory rail extends parallel to the bore axis of the barrel, or parallel to the cycling motion of the bolt assembly.

Additionally or alternatively, the receiver may form an accessory rail of a rail-interface system. The accessory rail may extend along at least a portion of the upper end of the receiver. The accessory rail may extend along the complete length of the forward extension, or to the front end of the receiver, which is the front end of the forward extension if the forward extension forms part of the receiver. This allows for an accessory rail that more or less extends along the complete length of the receiver. It further allows for stable accessory rail at a forward position on the automatic rifle. The screw hole of the forward extension may be aligned with the extension hole of the receiver. The screw hole may have a cylindrical shape. It may have a diameter that is greater than the diameter of the extension hole of the receiver. The screw hole may be concentric with the extension hole. This means that the screw hole is a counterbored hole relative to the extension hole. It also means that the barrel screw is centered on the barrel extension.

The barrel may have a rear portion with a cylindrical outer shape and a male threading. The barrel extension may have a barrel hole that is a through bore with a cylindrical shape matching the outer shape of the rear portion of the barrel. The rear portion of the barrel is positioned in the barrel hole and the barrel hole has a female threading that cooperates with male threading of the rear portion of the barrel.

The barrel extension may have a radial flange extending outwards, e.g. at its distal end or on its forward half. The radial flange may engage the receiver at the front end of the extension hole. As specified above, the barrel screw may engage the barrel extension, and it may press the radial flange against the receiver. The barrel screw may engage the radial flange.

As specified above, the bolt may be a rotationally locked bolt. This means that the bolt may be a rotating bolt that releasably locks to the barrel extension.

The receiver may form a beam, or support structure, extending from a point at the magazine well, or the lower well opening, to a point at a lower end of the forward extension of the receiver, to a point at the front end of the receiver, or to a point at the front end of the screw hole of the forward extension. The beam may further form a planar structure connecting to a front edge of the receiver at the magazine well and to a lower edge of the forward extension. The planar structure may be aligned with a vertical plane parallel to the bore axis of the barrel, or parallel to the cycling motion of the bolt assembly. It may have a generally triangular shape. The beam contributes to an improved stiffness in the vertical direction. Additionally, the beam may form a concave front edge, which allows for a convenient resting of the receiver on an edge when shooting.

The automatic rifle may comprise a forend attached to the forward extension. The forward extension may have forward facing screw holes for attaching the forend to the receiver.

It is understood that the receiver of the second aspect of the proposed technology may comprise any of the features of the receiver described in relation to the first aspect of the proposed technology. The receiver may have, or form, a magazine well arranged to receive a detachable magazine. The magazine well may have a magazine opening through which the magazine can be slidably inserted in the magazine well in an upward motion.

The receiver may have, or form, a rear opening through which the bolt assembly can be slidably removed in a backward motion. As specified above, the trigger mechanism may comprise a housing supporting a trigger and a hammer, and the receiver may have, or form, a trigger housing seat in which the housing can be positioned. The trigger housing seat may have a lower seat opening through which the housing can be slidably removed in a downward motion, or slidably inserted in an upward motion.

The receiver may be configured to house and/or support a (complete) safety biasing mechanism of a safety mechanism, as is specified above.

The receiver may have, or form, an extension hole and a forward extension, wherein the extension hole is arranged to receive a barrel extension of a barrel assembly, and the forward extension forms a screw hole having a female threading and that is aligned with the extension hole.

The receiver may form a bolt way that can house or houses, a bolt assembly. The receiver may further form a key way that can receive a charging handle and in which a carrier key, or carrier appendix, can travel during the cycling of a bolt assembly. The key way is a groove that extends parallel to the bore axis and is located at the upper end of the bolt way, or the receiver. It may have a profile or transverse cross section that is smoothly curved, or has a rounded profile, at its upper end. It is understood that the key way opens to the bolt way at its lower end.

BRIEF DESCRIPTION OF THE DRAWINGS

Different embodiments of the proposed technology are described below. References are made to the following figures, wherein.

DETAILED DESCRIPTION

Figures 1A, 1B, 1C, 1D, 1E, 1F:
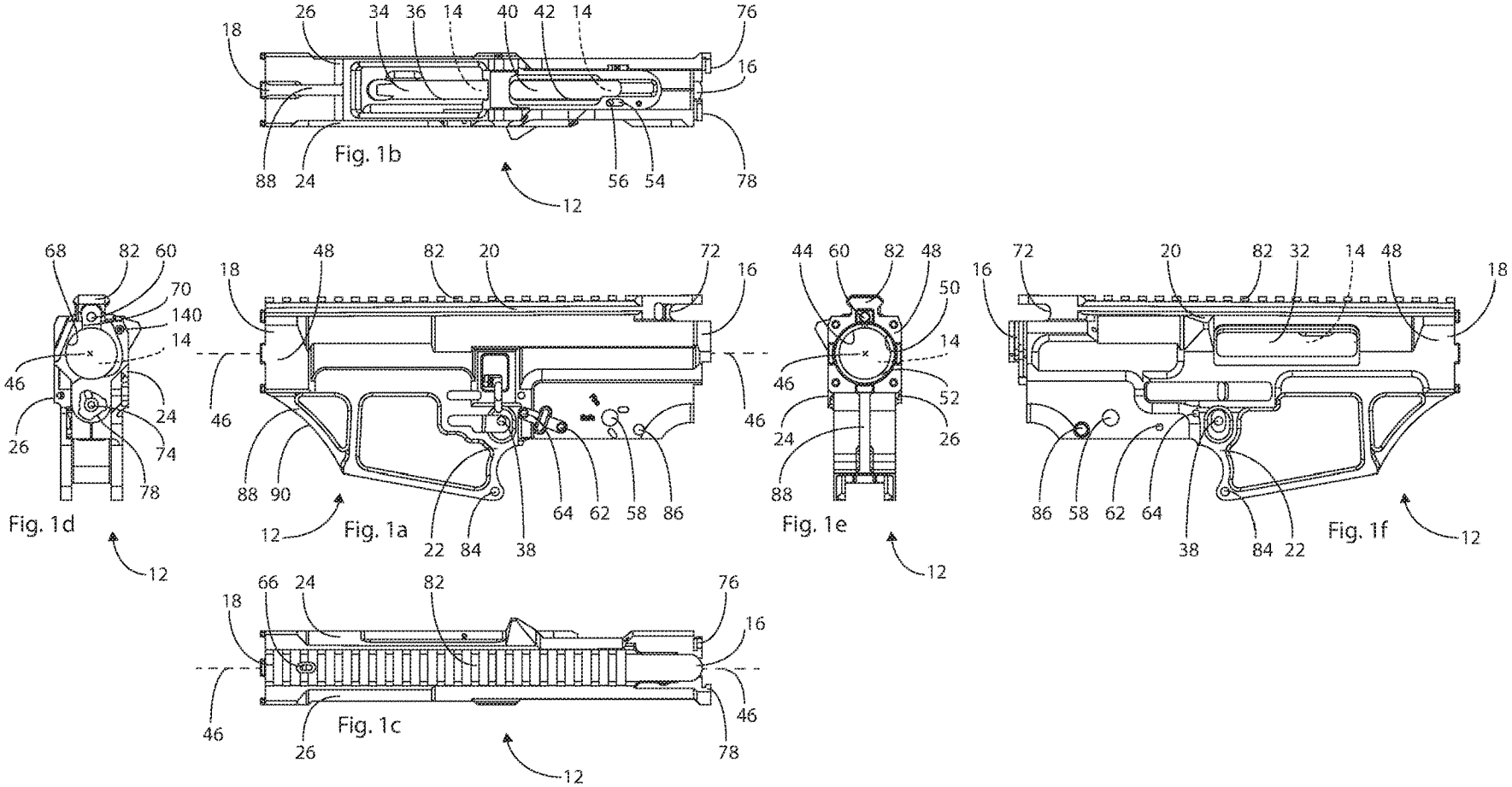
FIGS. 1*a* to 1*f* are planar projections of an embodiment of a receiver.
Figure 2A:
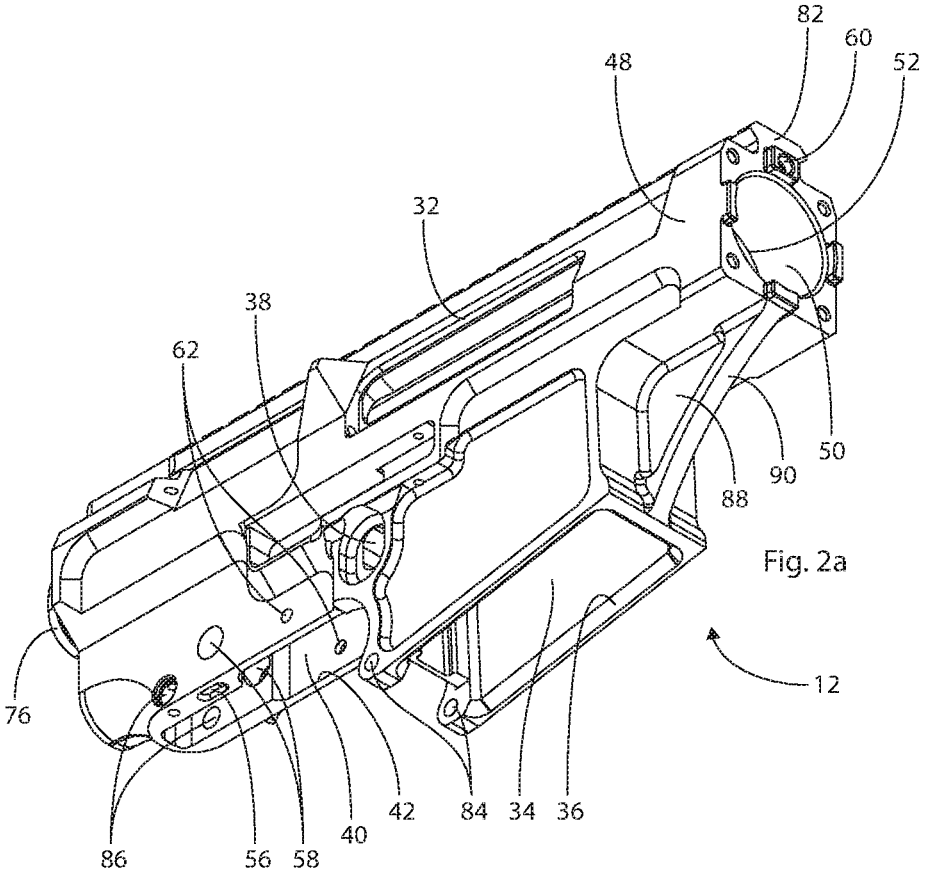
FIGS. 2*a* and 2*b* are perspective views of the receiver shown in FIGS. 1*a* to 1*f;*
Figure 2B:
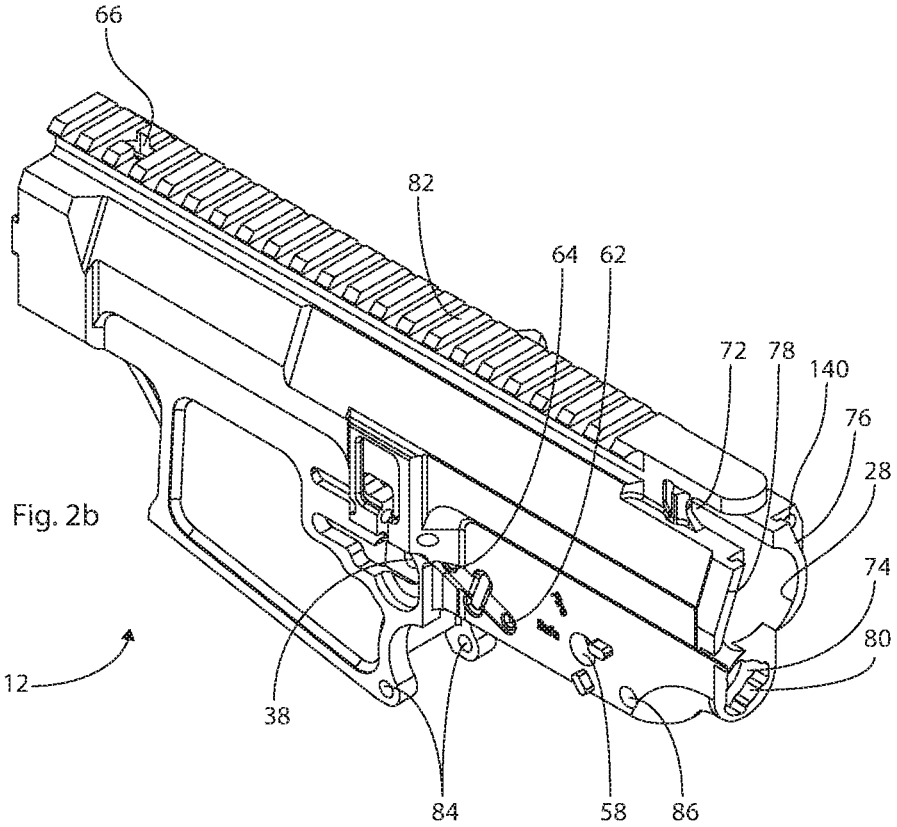

An embodiment of a receiver 12 for an automatic rifle 10 is shown in FIGS. 1*a* to 1*f* and in FIGS. 2*a* and 2*b*. It is intended to function with common components of AR-15 style rifles that are based on the ArmaLite AR-15 design.

The receiver 12 has a rear end 16, front end 18, upper end 20, lower end 22, a right side 24, and a left side 26. The orientations referred to here are with the rifle firing in a horizontal direction with the grip assembly positioned directly below the receiver.

The receiver has been manufactured by machining a single piece of aluminum alloy. The receiver forms a bolt way 14 (space indicated by the dashed lines in FIGS. 1*b* and 1*d*-1*f*) that can house a bolt assembly. The bolt way 14 is accessible from the outside via a rear opening 28 at the rear end 16, an extension hole 30 at the front end 18, and an ejection port 32 on the right side 24.

The receiver 12 forms a magazine well 34 located below the bolt way 14 that can receive a detachable box magazine (not shown). The space of the magazine well 34 is open to the bolt way 14. The magazine well 34 can be accessed from below via a magazine opening 36 at the lower end 22 of the receiver 12. The magazine is inserted via the magazine opening 36. The receiver 12 further has holes 38 for a magazine catch (not shown) that can releasably lock the magazine to the receiver 12. The minimum height of the receiver at the magazine well 34 is preferably about 100 mm.

The receiver 12 forms a trigger housing seat 40 located below the bolt way 14 and behind the magazine well 34. The trigger housing seat 40 can receive the housing of a trigger mechanism in which the housing supports the trigger and the hammer. The space of the trigger housing seat 40 is open to the bolt way 14. The trigger housing seat 40 can be accessed from below via a trigger opening 42 at the lower end 22 of the receiver 12. The trigger housing with the trigger and the hammer can be inserted via the trigger opening 42. Additionally, the receiver has first pin holes 62 and second pin holes 64 that can receive an inner trigger pin securing the trigger and an inner hammer pin securing the hammer, respectively, thus locking the housing of the trigger mechanism to the receiver 12. The minimum height of the receiver at the trigger housing seat 40 is preferably about 85 mm.

The receiver 12 further forms the abovementioned extension hole 30 at the front end 16 of the receiver 14. The extension hole 30 is smooth, through-going, and can receive a portion of a barrel extension that is part of a barrel assembly. The extension hole 30 has a cylindrical shape centered on the bore axis 46 of the barrel of the barrel assembly.

The receiver 12 also forms a forward extension 48 at the front end 16 of the receiver 14 having a screw hole 50 that is countersunk relative to the extension hole 30 and centered on the bore axis 46. The screw hole 50 has a female threading and can receive a barrel screw with cooperating male threading that engages the barrel extension and press it against the receiver 12. The screw hole 50 has a larger diameter than the extension hole 30, thus forming a ledge 52 between them. The barrel extension has an annular flange at its forward end that engages the ledge 52. The barrel screw has a through bore that is centered on the bore axis 46 when the barrel screw is installed in the screw hole 50, at which the barrel extends through the through bore. The receiver has a hole 66 through which a barrel extension pin can enter the extension hole 30 and enter a bore in the barrel extension for the purpose of orienting the barrel assembly with respect to the receiver 12.

The receiver forms a beam 88 that extends from a point at the well opening 36 of the magazine well 34 to a point at the front end of the screw hole 50 of the forward extension 48. The beam 88 is a planar triangular structure aligned with a vertical plane and parallel to the bore axis 46. It has a concave front edge 90 and connects to the receiver 12 along a vertical line at the front of the magazine well 34 and along a horizontal line at the lower end of the forward extension 48.

The receiver has holes 58 for a safety lever. The receiver 12 has a blind bore 54 at its lower end 22 that is at a right angle to the bore axis 46. The blind bore 54 can receive a safety-detent spring that provides a pushing force in a downward direction. The receiver 12 also has a cut-out 56 for a detent lever. The cut-out forms a through hole to the bolt way 14 that can house a safety detent acting on the safety lever. The safety-detent spring, the detent lever, and the safety detent jointly form a safety biasing mechanism that together with the safety lever form a safety mechanism, which is supported by the receiver 12.

As mentioned above, the receiver 12 has a rear opening 28 at its rear end 16 through which a bolt assembly can be slidably inserted or removed parallel to the bore axis 46. The bolt assembly is then housed in the bolt way 14 of the receiver 12. The receiver 12 forms a key way 70 that can receive a charging handle and in which a carrier key or carrier appendix can travel during the cycling of a bolt assembly. The key way 70 is a groove that extends parallel to bore axis 46 and is located at the upper end of the bolt way 14, or receiver 12. The key way 70, has a profile or transverse cross section that is smoothly curved, or it has a rounded profile at its upper end, or at the upper end of the receiver 12. It opens to the bolt way 14 at the lower, or opposed, end. The receiver 12 further forms a cut out 72 at its rear end 16 that can receive the end of the charging handle.

The receiver has a through-going gas-conduit bore 60 at its front end 18 and above the extension hole 30 through which the gas conduit of a direct impingement system enters the key way 70.

The receiver 12 has a pivot recess 74 that can form a first pivot with a pivot protrusion of a buttstock adaptor of a buttstock assembly. At its rear end 16, the receiver 12 forms a first receiver flange 76 at its right side 24 and a second receiver flange 78 at its left side 26 that can cooperate with a first adaptor flange and a second adaptor flange, respectively, formed by an adaptor body of the buttstock adaptor. The first receiver flange 76 and the second receiver flange 78 are located above the pivot recess 74. The receiver 12 further forms third receiver flanges 80 at the edge of the pivot recess 74 that can cooperate with pivot flanges of the abovementioned pivot protrusion.

The receiver 12 has pivot-pin holes 84 and lock-pin holes 86 that can receive a pivot pin and a lock pin respectively that attach a grip assembly to the receiver 12 at the lower end 22 of the receiver 12 and behind the magazine opening 36.

The receiver 12 forms an accessory rail 82 at its upper end 20 and that extends parallel to the bore axis 46. The accessory rail 82 extends along the complete length of the forward extension 48.

Figure 3:
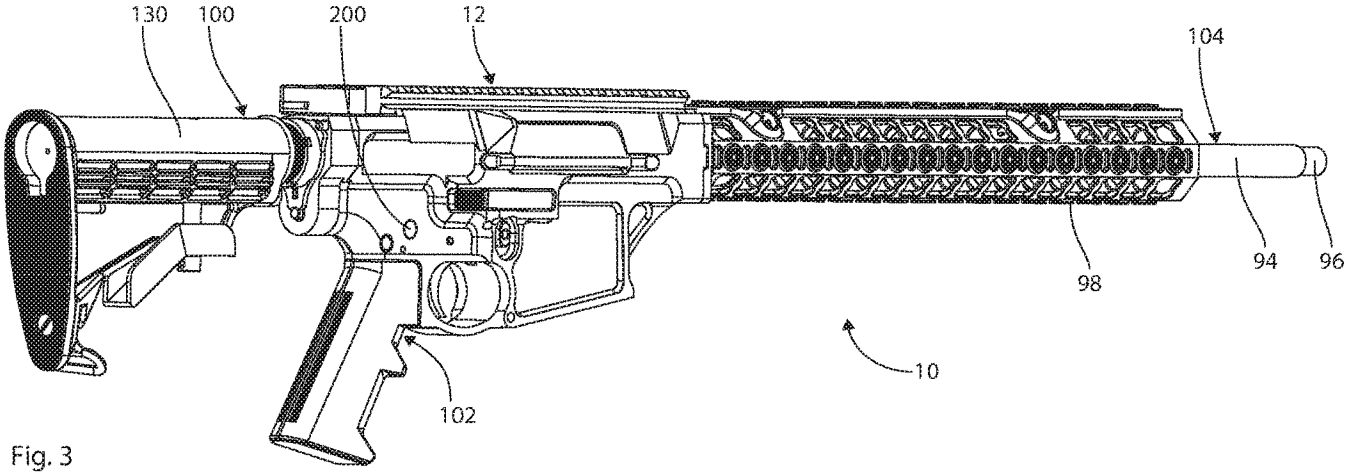
FIG. 3 is a perspective view of an embodiment of an automatic rifle with the receiver shown in the previous figures.

FIG. 3 is a perspective of an embodiment of an automatic rifle 10 with the previously described receiver 12 fitted with a buttstock assembly 100, grip assembly 102, and a barrel assembly 104. The barrel 94 has a male threading at its front end 96 on which a flash suppressor can be mounted. Additionally, the automatic rifle 10 is fitted with a forend 98 at the front end 18 of the receiver 12.

Figure 4:
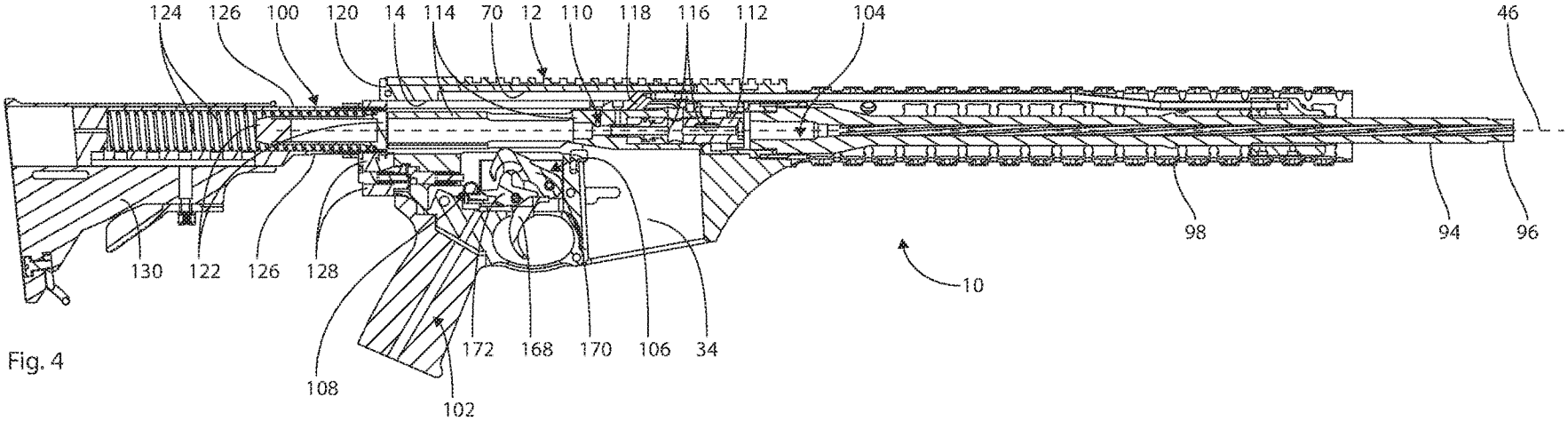
FIG. 4 is a cross-sectional view of the automatic rifle shown in FIG. 3.

FIG. 4 is a through-cut of the assault rifle 10 further showing its trigger mechanism 106, safety mechanism 108, and a bolt assembly 110. The buttstock assembly 100 is connected to the rear end 16 of the receiver 12 and is positioned behind the bolt assembly 110. The barrel assembly 104 is connected to the front end 18 of the receiver 12 and is positioned in front of the bolt assembly 110. The grip assembly 102 is positioned below the receiver 12, thus also below the bolt assembly 110. The trigger mechanism 106 is positioned below the bolt assembly 110. The receiver 12 has the magazine well 34 located below bolt assembly 110 and in front of the grip assembly 102.

The bolt assembly 110 is slidably supported in the bolt way 14 of the receiver 12. The bolt assembly 110 has a rotationally lockable bolt 112, a bolt carrier 114, a firing pin channel 116 in which a firing pin (not shown) can be fitted, and a carrier key 118. The carrier key 118 is attached to the upper end of the bolt carrier 114. In the cycling of the bolt assembly 110, the bolt 112 and the bolt carrier 114 slide in the bolt way 14, and the carrier key 118 slides in the key way 70. A charging handle 120 is inserted in the key way 70 and engages the carrier key 118 at the front of the carrier key 118. The bore axis 46 is indicated by a dashed line and the bolt assembly moves parallel to this axis when cycling.

The buttstock assembly 100 has a buffer 122, an action spring 124, and a buffer tube 126 that houses the buffer 122 and the action spring 124. The buffer tube 126 has a rear end at which the action spring 124 rests. The action spring 124 engages the buffer 122 and biases the buffer 122 in a forward position inside the buffer tube 126. During a cycling of the bolt assembly 110, the bolt carrier 114 engages the buffer 122, and a rear portion of the bolt carrier 114 enters the buffer tube 126. The buttstock assembly 100 further has a buttstock adapter 128 attached to the buffer tube 128 and to the receiver 12 at the rear opening 28 of the receiver 12. A buttstock 130 is slidably attached to the buffer tube 126, and it can be locked at different positions along the buffer tube 126.

Figure 5A:
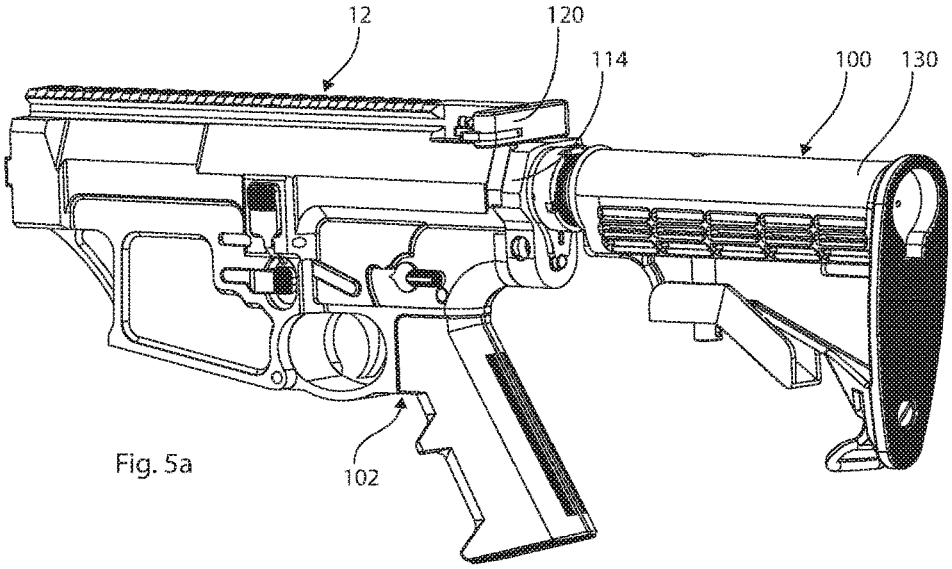
FIGS. 5*a* to 5*c* are perspective views of the receiver, grip assembly, and buttstock assembly of the automatic rifle shown in FIG. 3, with the latter in different orientations relative to the receiver.
Figure 5B:
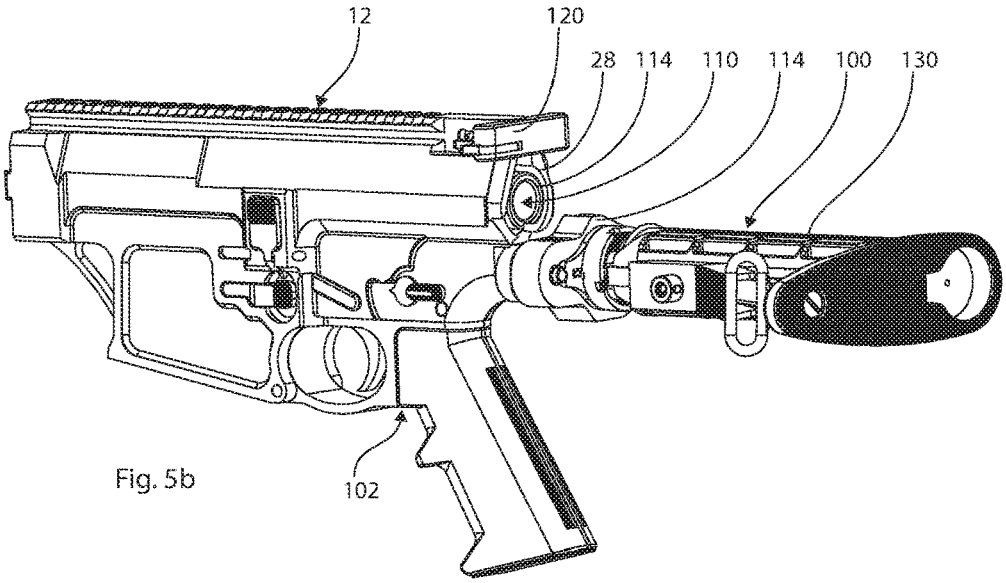
Figure 5C:
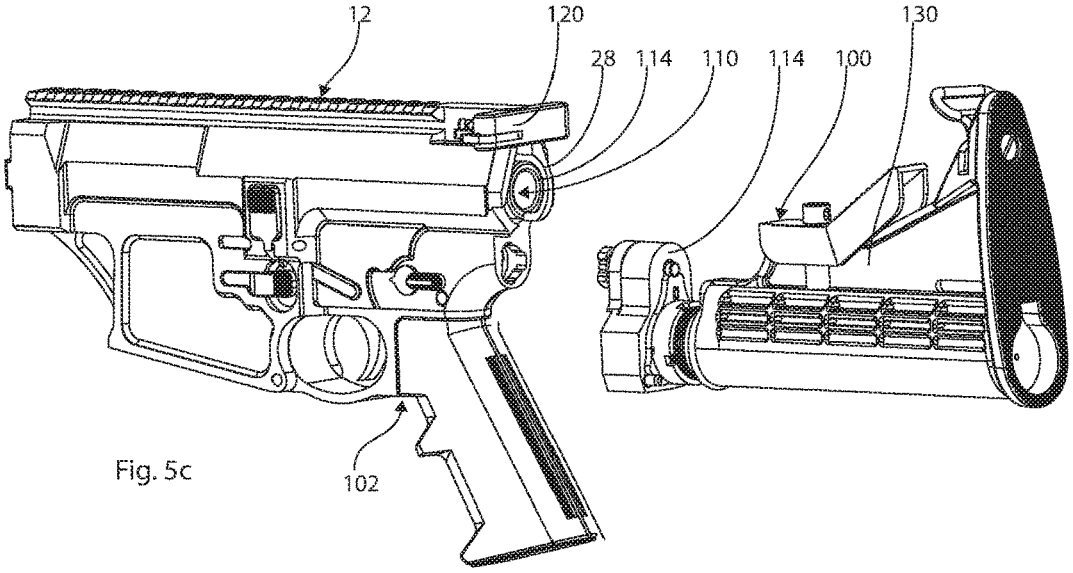

FIGS. 5*a* to 5*c* are perspective views of the buttstock assembly 100 in different orientations relative to the receiver 12. The buttstock assembly 100 is rotationally connected to the receiver 12 by a first pivot defined by the buttstock adaptor 128 and the receiver 12. FIG. 5*a* shows the buttstock assembly 100 in a closed orientation relative to the receiver 12, at which the bolt assembly 110 is prevented from being removed through the rear opening 28 of the receiver 12. FIG. 5*b* shows the buttstock assembly 100 in an open orientation relative to the receiver 12, at which the bolt assembly 110 can be removed through the rear opening 28 of the receiver 12. The buttstock assembly 100 reaches the open orientation from the closed orientation by a clock-wise rotation around an axis parallel to the bore axis 46, which is defined by the first pivot. In FIG. 5*c* the buttstock assembly 100 has been detached from the receiver 12 and is in a released orientation.

Figure 6:
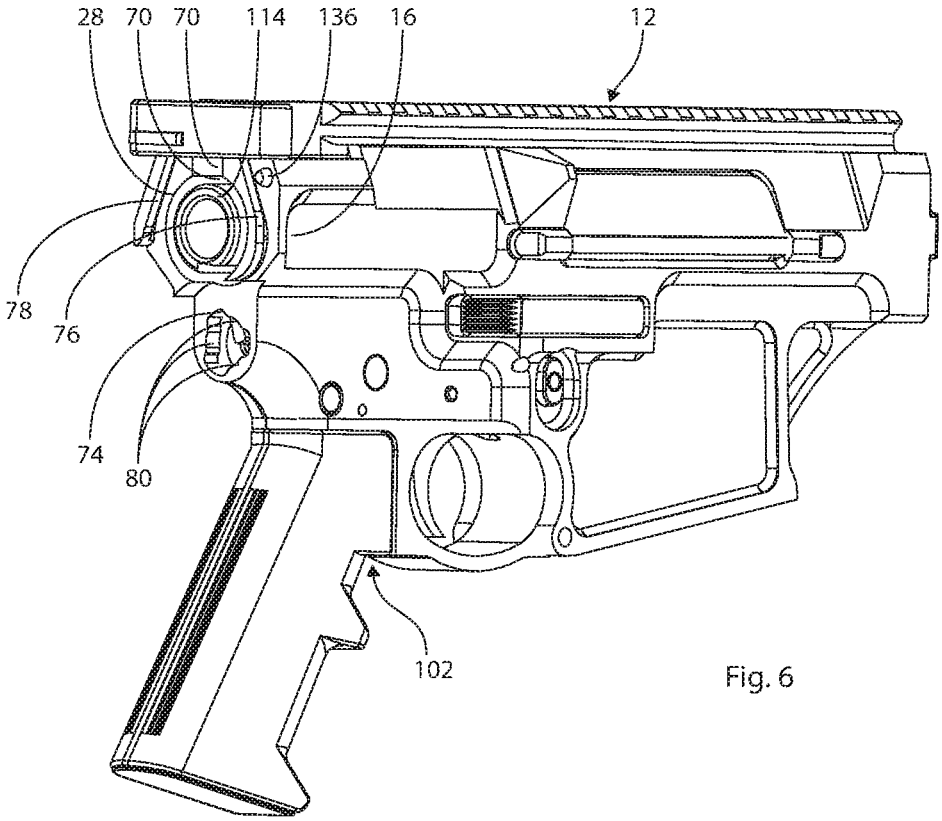
FIG. 6 is a perspective view of the rear end of the receiver and the grip assembly of the automatic rifle shown in FIG. 3.

FIG. 6 is a perspective view of the rear end 16 of receiver 12 of the automatic rifle 10 showing the abovementioned pivot recess 74, first receiver flange 76, second receiver flange 78, and third receiver flange 80

Figure 7A:
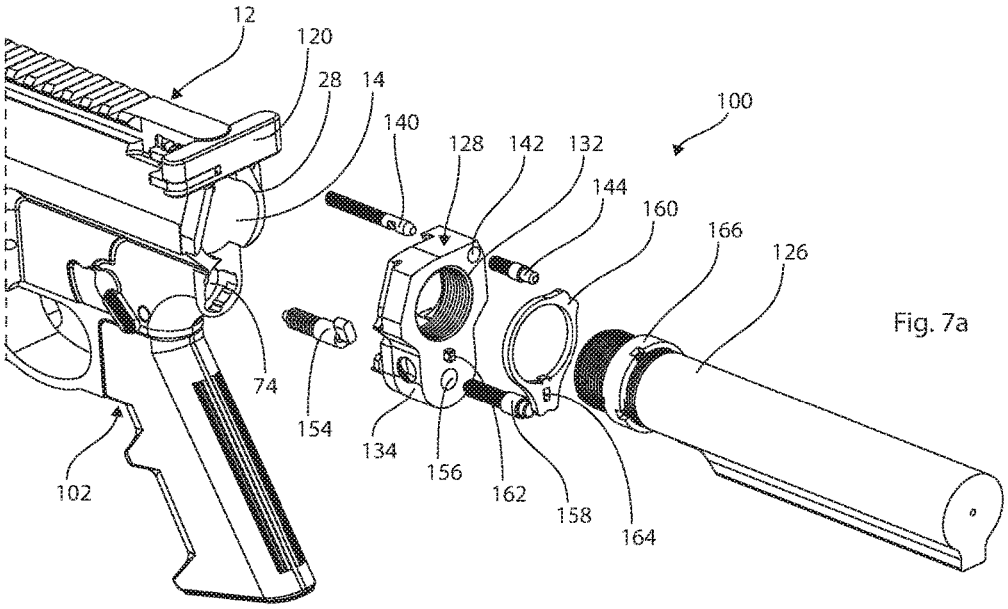
FIGS. 7*a* and 7*b* are partly exploded and perspective views of the buttstock assembly and the rear end of the automatic rifle shown in FIG. 3.
Figure 7B:
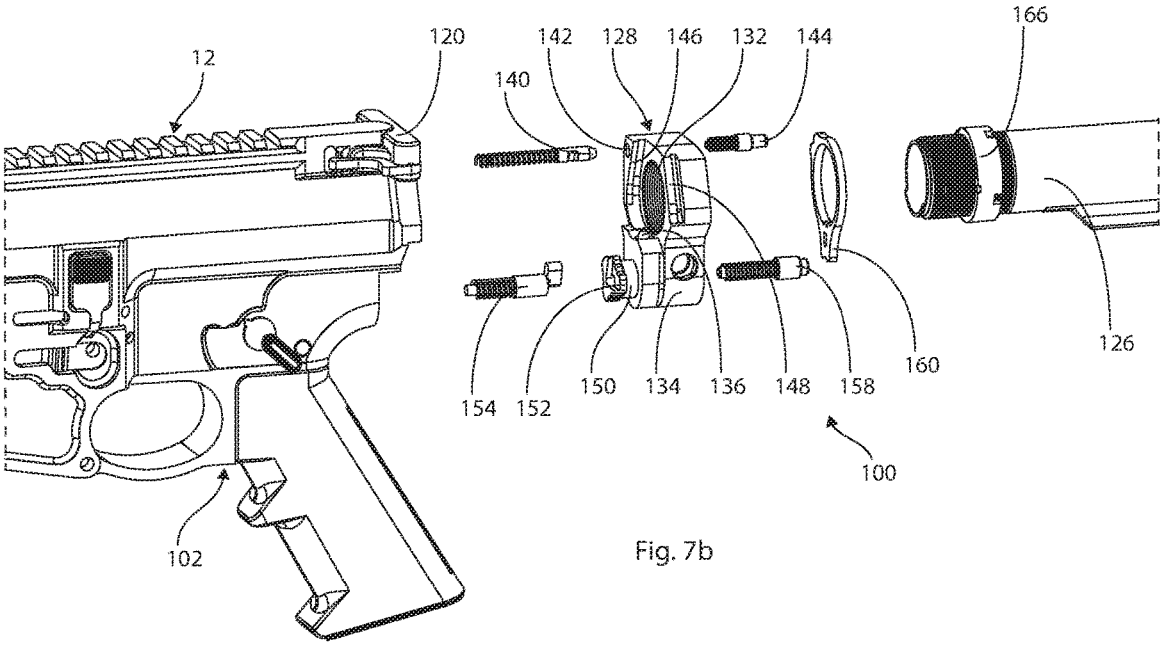

FIGS. 7*a* and 7*b* are partly exploded and perspective views of the buttstock assembly 100 and the rear end 16 of the automatic rifle 10.

The buttstock adaptor 128 has a unitary adaptor body 134 machined from a single piece of an aluminum alloy. The adaptor body 134 forms a bolt carrier opening 132 that is aligned with the rear opening 28 and the bolt way 14 of the receiver 12 when the buttstock assembly 100 is in its closed orientation, as is shown in FIG. 5*a*.

The bolt carrier opening 132 is provided with a female threading and the buffer tube 126 has a front portion with a matching male threading. The front portion is located inside the bolt carrier opening 132 and engages its female threading. The rear portion of the bolt carrier 114 passes through the bolt carrier opening 132 and enters the buffer tube 126 during the cycling of the bolt assembly 110.

The carrier key 118 constitutes a transversely protruding portion of the bolt assembly 110 that cannot pass though the bolt carrier opening 132 when the buttstock assembly 100 is in its closed orientation relative to the receiver 12. In other words, the carrier key 118 causes the bolt assembly 110 to have a transverse extension in the vertical direction that is greater than the diameter, or transverse vertical extension, of the bolt carrier opening 132. This means that the buttstock adapter 128 prevents the bolt assembly 110 from being removed through the rear opening 28 of the receiver 12.

When the buttstock assembly 100 is in its open orientation relative to the receiver 12, as is illustrated in FIG. 5*b*, the adaptor body 134 has been rotated relative to the receiver 12 such that it no longer partly blocks the rear opening 28, whereby the bolt assembly 110, including the carrier key 118, can be removed through the rear opening 28 of the receiver 12 together with the charging handle 120.

The buttstock adaptor 128 has a buffer retainer 136 in the form of a spring biased detent supported in the adaptor body 134 and positioned in front of the bolt carrier opening 132. The buffer retainer 13 prevents the buffer 122 from leaving the buffer tube 126 through the bolt carrier opening 132 when the buttstock assembly 100 is in its open position relative to the receiver 12, or when it is removed from the receiver 12.

The adaptor body 134 of the buttstock adaptor 128 forms a first adaptor flange 146 and a second adaptor flange 148 on either side of the bolt carrier opening 132. Both adaptor flanges 146 and 148 have rims facing in the same general direction (left), as can be seen in FIG. 7*b*. The first adaptor flange 146 and the second adaptor flange 148 engage the first receiver flange 76 and the second receiver flange 78, respectively, when the buttstock assembly 100 is in its closed orientation relative to the receiver 12.

The adaptor body 134 further forms a pivot shaft 150 below the bolt carrier opening 132. The pivot shaft 150 has a pivot flange 152 at its forward end. In both the closed and open orientations of the buttstock assembly 100, the pivot shaft 150 and the pivot flange 152 are inserted in the pivot recess 74 at the rear end 16 of the receiver. The pivot flange 152 engages the third receiver flange 80 at the pivot recess 74 in these positions, which prevents the buttstock assembly 100 from moving backwards relative to the receiver 12 in both orientations.

The pivot shaft 150, the pivot flange 152, the pivot recess 74, and the third receiver flange 80 define the first pivot, which means that the first pivot engages the receiver 12 at a point below the rear opening 28 of the receiver 12, and that the buttstock assembly 100 is connected to the receiver 12 also in its open orientation.

The buttstock adaptor 128 has a spring biased first locking pin 138 with a truncated conical head at its rear end. The first locking pin 138 is supported at the rear end 16 of the receiver 12 in a first locking pin hole 140; see FIGS. 1*d* and 2*d*. The conical head of the first locking pin 138 engages a cylindrical portion of a first through bore 142 in the adaptor body 134 when the buttstock assembly 100 is in its closed orientation relative to the receiver 12. The base of the conical head has a greater diameter than the cylindrical portion, while its truncated tip has a smaller diameter then the cylindrical portion, thus locking the buttstock assembly 100 in its closed orientation.

The buttstock assembly 100 is released from the closed orientation by pressing the spring biased first locking pin 138 towards the receiver 12. This is achieved by pressing a spring biased first extension pin 144 supported in the first through bore 142 in the adaptor body 134, and the first extension pin 144 in turn engages and presses against the first locking pin 138. The buttstock assembly 100 can then be rotated from its closed position, as is shown in FIG. 5*a*, to its open orientation, as is shown in FIG. 5*b*. Alternatively to the first extension pin 144, the first locking pin may be engaged by a thin object, such as the tip of a bullet, via the first through bore 142.

The buttstock adaptor 128 has a spring biased second locking pin 154 with a flanged head at its rear end. The second locking pin 154 is supported in the pivot recess 74 and its flanged head cooperates with the third receiver flange 80 and the pivot flange 152. The buttstock assembly 100 is released from the open orientation by pressing the spring biased second locking pin 154 towards the receiver 12, whereby the buttstock assembly 100 can be removed from the receiver 12. This is achieved by pressing a spring biased second extension pin 158 supported in a second through bore 156 in the adaptor body 134. The second extension pin 158 in turn engages and presses against the second locking pin 154. The buttstock assembly 100 can then be changed from its open position, as is shown in FIG. 5*b*, to its released orientation, as is shown in FIG. 5*c*, in which it is completely disengaged from the receiver 12. This means that buttstock assembly 100 is releasably locked to the receiver 12 in both the closed and open orientations.

The buttstock adaptor 128 has a retainer washer 160 securing the spring biased first extension pin 144 in the first through bore 142 and the spring biased second extension pin 158 in the second through bore 156. The orientation of the retainer washer 160 relative to the adaptor body 134 is fixed by a retainer pin 162 at the rear end of the adaptor body 134 and a cooperating retainer pin hole 164 in the retainer washer 160.

The buttstock assembly may further have a rotation locker 166 in the form of a nut positioned on the proximal portion of the buffer tube 126 and cooperating with the male threading on the proximal portion. The rotation locker 166 presses against the retainer washer 160, which in turn presses against the adaptor body 134, thus fixing the retainer washer and preventing the buffer tube 126 from rotating relative to the adaptor body 134.

Figure 8A:
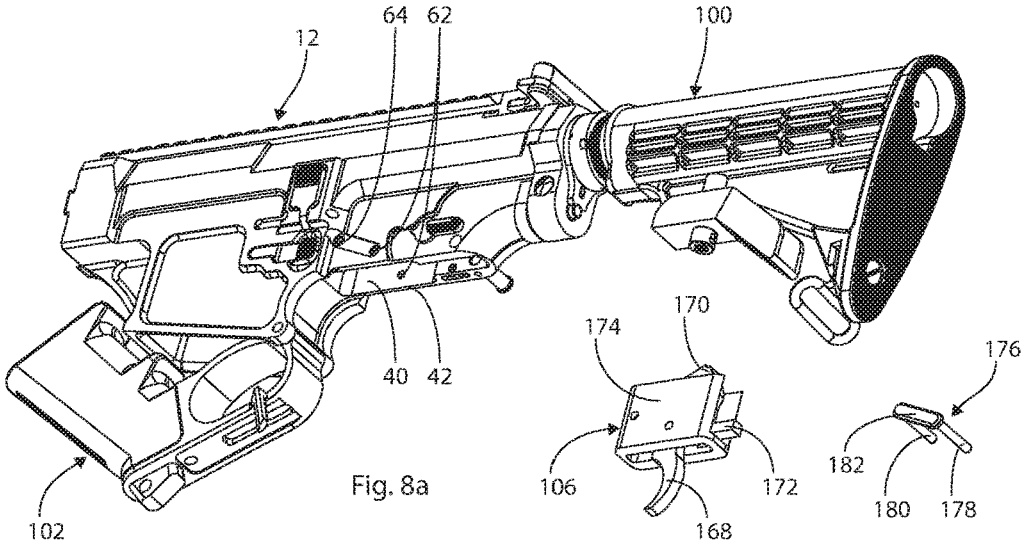
FIGS. 8*a* to 8*c* show the insertion of the trigger mechanism in the receiver of the automatic rifle shown in FIG. 3 and the different orientations of the grip assembly.
Figure 8B:
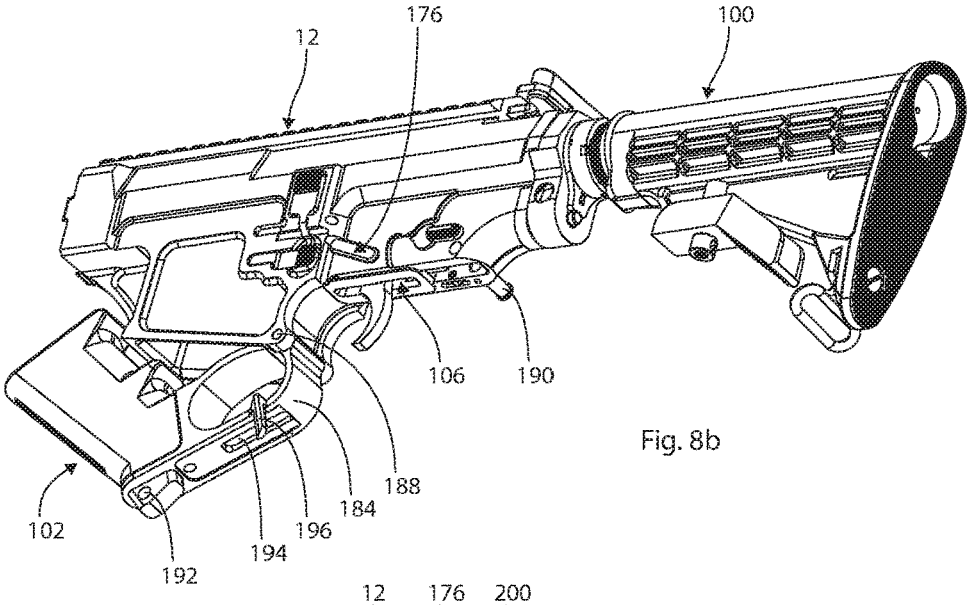

FIGS. 8*a* and 8*b* show the insertion of the trigger mechanism 106 in the receiver 12. The trigger mechanism 106 has a trigger 168, a hammer 170, and a disconnector 172 operationally connected to one another; see also FIG. 4. The trigger mechanism 106 further has a housing 174 and the trigger 168 and the disconnector 172 are rotationally connected to the housing 174 by a hollow trigger pin (not shown), and the hammer 170 is rotationally connected to the housing 174 by a hollow hammer pin (not shown). This way, the housing 174 supports and partly encloses the trigger 168, hammer 170, and disconnector 172.

As mentioned above in relation to FIGS. 1*a* to 1*f*, the receiver 12 forms a trigger housing seat 40 that can be accessed from below via a trigger opening 42 at the lower end 22 of the receiver 12. The housing 174 of the trigger mechanism is received in the trigger housing seat 40, as is illustrated in FIG. 8*b*.

The trigger mechanism 106 further has a pin assembly 176 formed by an inner trigger pin 178, an inner hammer pin 180, and a beam 182 rigidly connecting the inner trigger pin 178 and the inner hammer pin 180. The receiver 12 further has a first pin hole 62 and a second pin hole 64. The housing 174 of the trigger mechanism 106 is locked relative to the receiver by the inner trigger pin 178 being inserted in the first pin holes 62 and the hollow trigger pin (not shown), and by the inner hammer pin 180 being inserted in the second pin holes 64 and the hollow hammer pin (not shown), as is shown in FIG. 8*b*.

The grip assembly 102 has a grip base 184 forming a trigger guard. A pistol grip 186 is rigidly attached to the grip base 184. The grip base 184 is connected to the receiver 12 by a pivot pin 188 engaging the grip base 184 at its front end. The pivot pin 188 is oriented horizontally and transverse to the bore axis 46 and forms a second pivot by which the grip assembly 102 is rotationally connected to the receiver 12.

The grip assembly 102 has an open orientation relative to the receiver 12 in which the trigger mechanism 106 can be inserted in or removed from the trigger housing seat 40, as is shown in FIG. 8*b*.

Figure 8C:
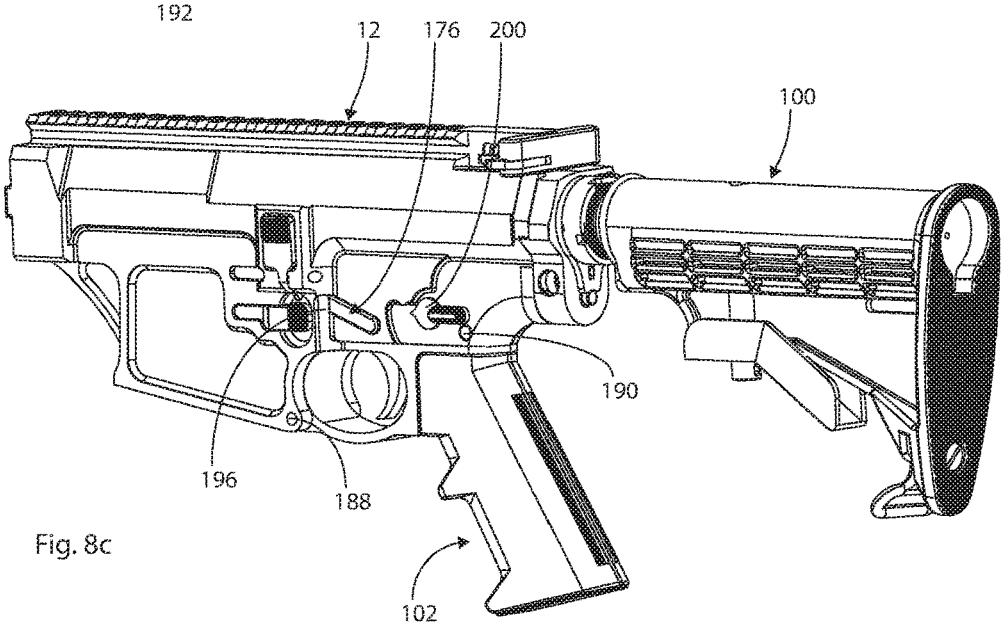

The grip assembly 102 has a closed orientation relative to the receiver 12 in which the trigger mechanism 106 is prevented from being removed from the trigger housing seat 40 by the grip base 184 of the grip assembly 102, as is shown in FIG. 8*c*. In this orientation, the grip base 184 is locked to the receiver 12 by a lock pin 190 entering a lock pin hole 192 of the grip base 184 at the rear end of the grip base 184. The grip base 184 forms a trigger slit 194 in the upper end of the trigger guard through which the trigger 168 extends.

The grip base 184 has an upward extending portion 196 in the form of a pin extending along the left side 26 of the receiver 12. The upward extending portion 196 engages the beam 182 of the pin assembly 176 in the closed orientation of the grip assembly 102, thus securing the pin assembly 176 relative to the receiver 12.

Figure 9:
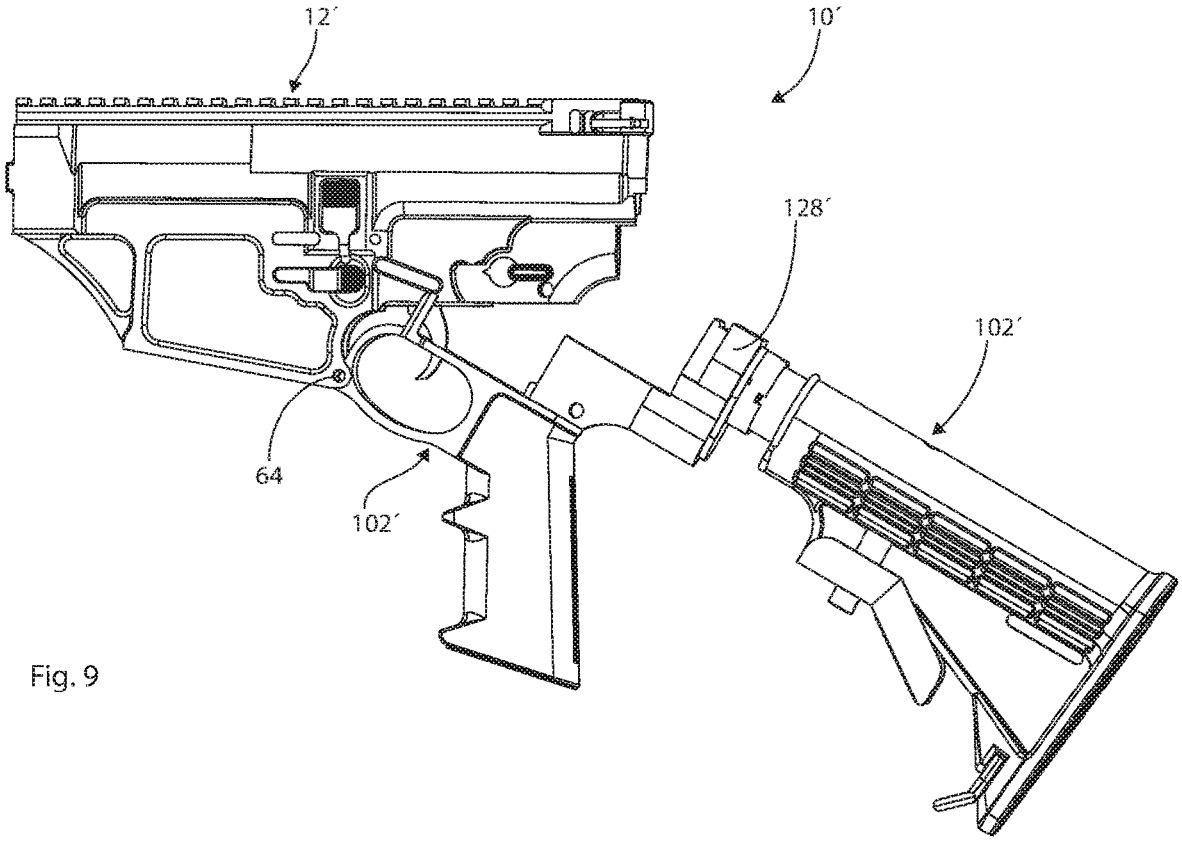
FIG. 9 shows an alternative embodiment of an automatic rifle with different buttstock and grip assemblies.

An alternative embodiment of an automatic rifle 10' is shown in FIG. 9. This embodiment differs in that the first pivot has a pivot pin 198 arranged horizontally and transversely with respect to the bore axis. The grip assembly 102' form part of the buttstock adapter 128' and the pivot pin 198 engages and connects to the grip assembly at the front end of the grip assembly 102'. The grip assembly 102' and the buttstock adaptor 128' are connected and jointly form a rigid structure. This way, the first pivot is arranged to rotate the buttstock assembly 100' around a transverse horizontal axis.

Figure 10:
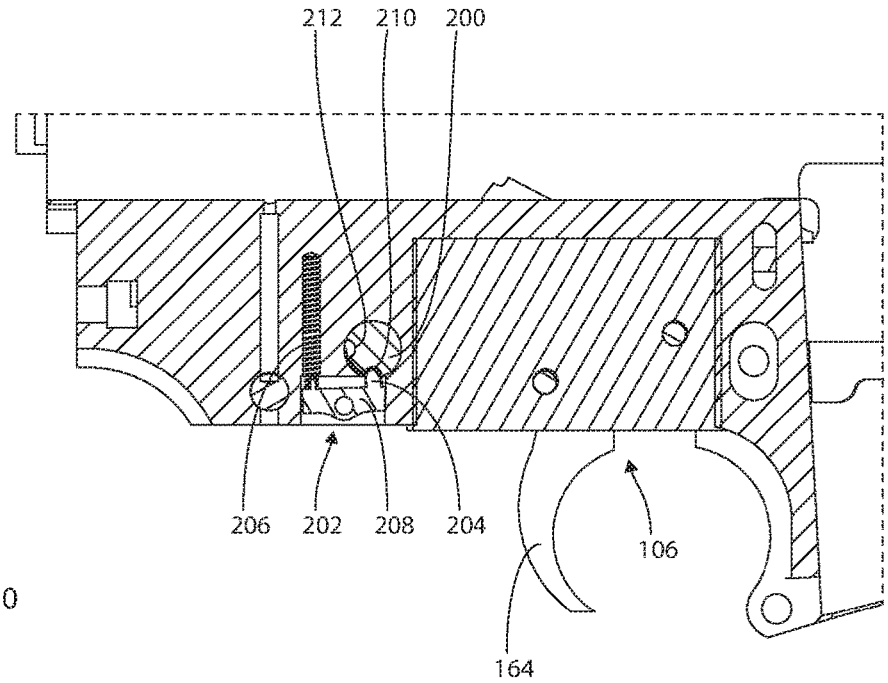
FIG. 10 is a cross sectional view of a part of the automatic rifle shown in FIG. 3 showing its safety mechanism.

FIG. 10 is a cross sectional view of a portion of the automatic rifle 10 showing the internals of the safety mechanism 108. The safety mechanism 108 has a safety lever 200, see also FIGS. 3 and 8*c*, and a safety biasing mechanism 202. The safety biasing mechanism 202 has a safety detent 204 and a safety-detent spring 206 that is operationally connected to the safety detent 204 by way of a detent lever 208. The safety detent 204 and the detent lever form a unitary body. The safety biasing mechanism 202 as a whole is housed in the receiver 12.

The safety-detent spring 206 is a compression coil spring generating a downward force that is transformed to an upward force by the detent lever 208 that pushes the safety detent 24 against the safety lever 200.

The safety lever 200 has a first setting in which it engages the trigger 164 and prevents the trigger mechanism 106 from firing. The safety lever 200 further has a second setting in which it does not engage the trigger 164 or disconnector 172, whereby the trigger mechanism 106 can fire a single shot when the trigger 164 is pulled. The safety lever 200 has a first recess 210 that receives the safety detent 204 in the first setting and a second recess 212 that receives the safety detent 204 in the second setting. This way, the safety lever 200 is biased in the respective settings.

Figure 11:
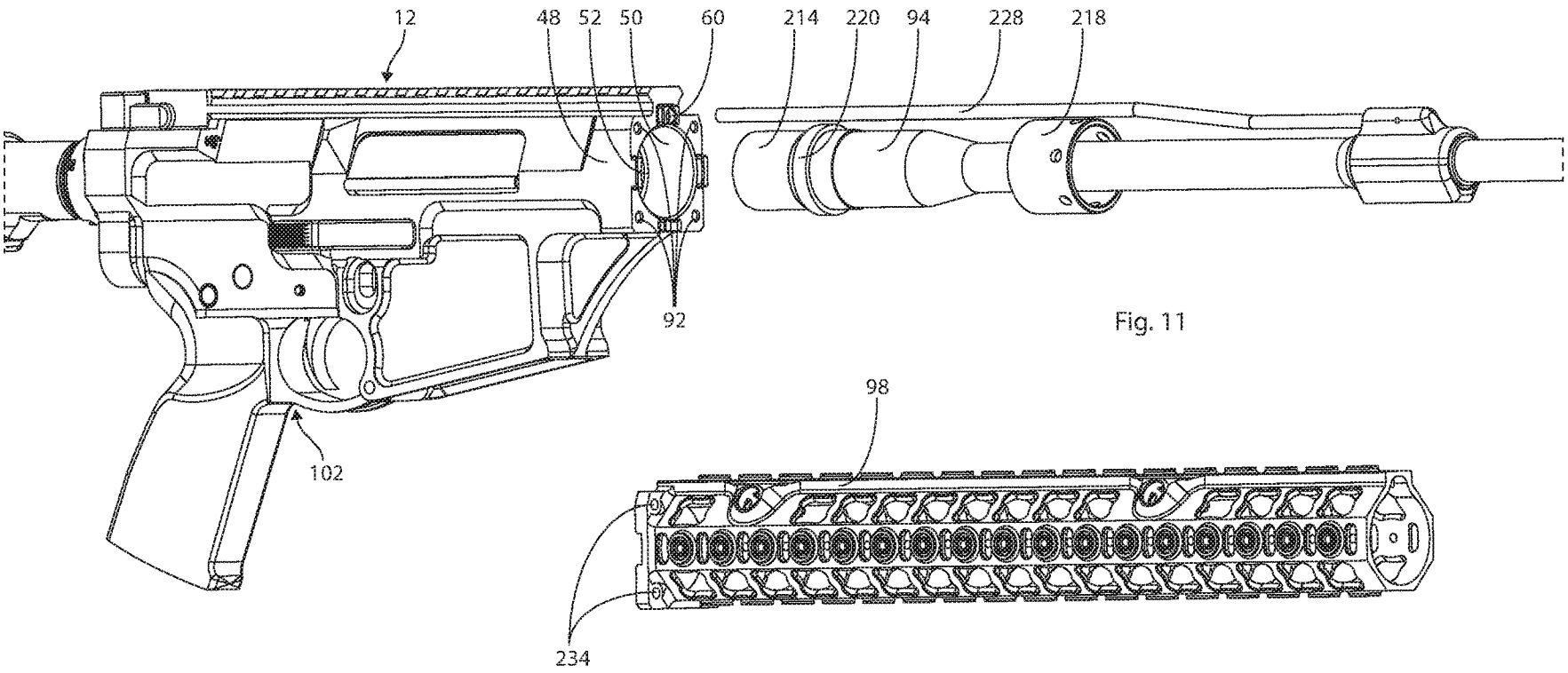
FIG. 11 is a partly exploded and perspective view of the barrel assembly of the automatic rifle shown in FIG. 3.
Figure 12:
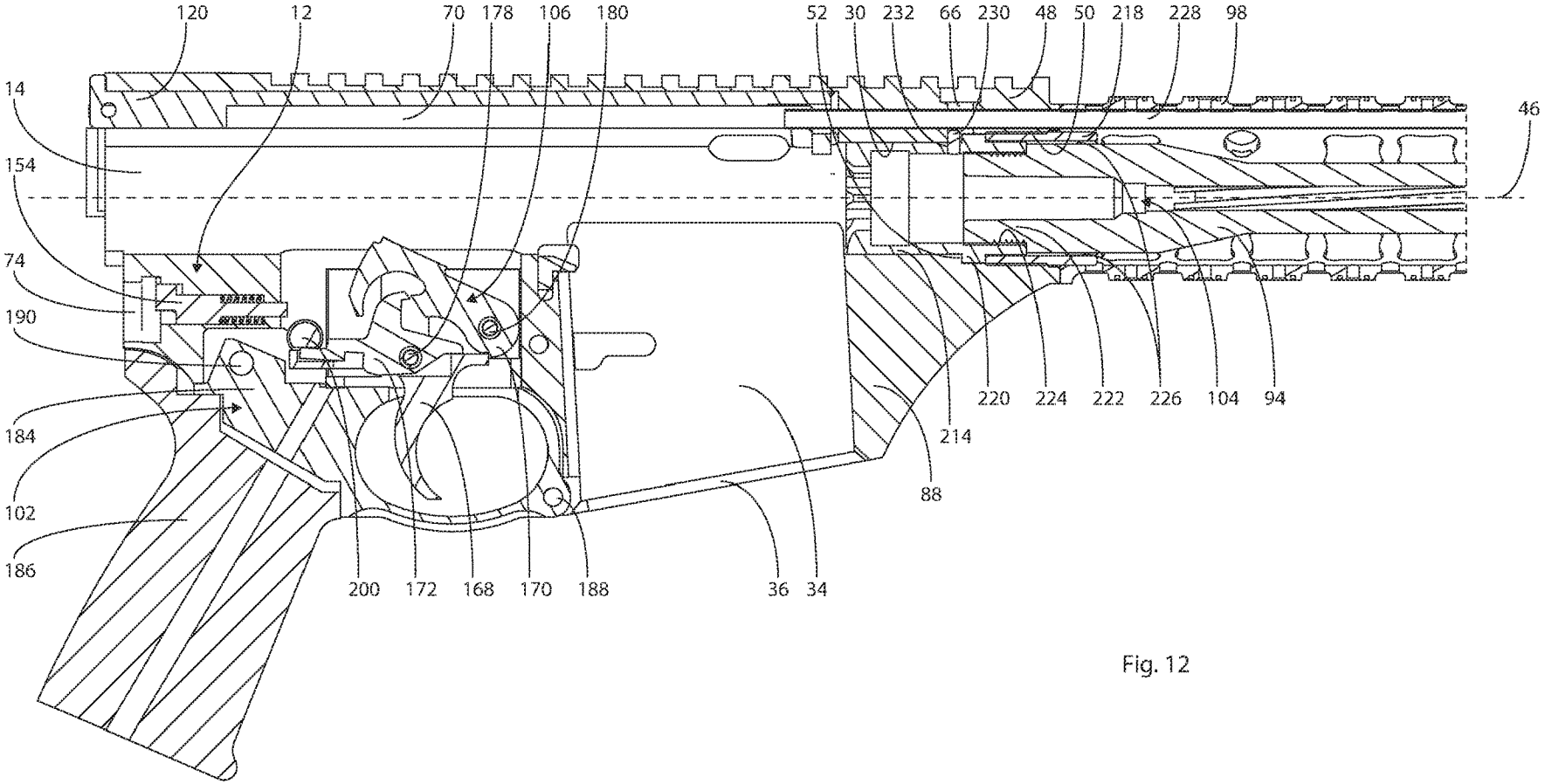
FIG. 12 is cross-sectional view of a part of the rifle shown in FIG. 3 showings its trigger mechanism, grip assembly, and barrel assembly.

FIG. 11 is a partly exploded and perspective view of the barrel assembly 104 of the automatic rifle 10, and FIG. 12 is a cross-sectional view of the rifle 10 showings its receiver 12, trigger mechanism 106, grip assembly 102, and barrel assembly 104.

The barrel assembly 104 has a barrel 94 and a barrel extension 214 supporting the barrel 94. As mentioned above, the receiver 12 forms a through-going extension hole 30 at its front end 18. The rear portion of the barrel extension 214 has an outer smooth cylindrical shape that matches the smooth cylindrical shape of the extension hole. This way, the rear portion of the barrel extension closely fits in the extension hole 30.

The receiver 12 further forms a forward extension 48 of the barrel assembly 104 at the front end 18 of the receiver 12, which means that the forward extension 48 is fixed relative to the rest of the receiver 12. The forward extension 48 forms a screw hole 50 with a female threading. The combined length of the extension hole 30 and the screw hole 50 is 55 mm.

As mentioned above, the screw hole 50 has a larger diameter than the extension hole 30, and the receiver 12 thus forms a ledge 52 therebetween. The barrel extension 214 has a radial flange 220 that extends outwards and engages the ledge 52 at the front end of the extension hole 30.

The barrel assembly 104 further has a barrel screw 218 with a rear portion positioned in the screw hole 50 and having a male threading cooperating with the female threading of the screw hole 50. The threadings of the screw hole 50 and the barrel screw 218 are not shown in FIGS. 11 and 12. The barrel screw 218 engages the barrel extension 214 at the radial flange 220 and presses the radial flange 220 against the ledge 52 formed by the receiver 12.

The barrel screw 218 forms a gap 226 between itself and the barrel 94 and the barrel 94 extends through the barrel screw 218 without touching the barrel screw 218.

The barrel 94 has a rear portion 222 with a cylindrical outer shape and a male threading. The barrel extension 214 has a barrel hole 224 that is a through bore with a cylindrical shape matching the outer shape of the rear portion 222 of the barrel 94. The rear portion 222 of the barrel 94 is positioned in the barrel hole 224, and the barrel hole 224 has a female threading that cooperates with male threading of the rear portion 222 of the barrel 24, thereby fixing the barrel 94 relative to the barrel extension 214.

As mentioned above, the receiver 12 has a gas-conduit bore 60 at its front end 18. The automatic rifle 10 is gas operated, and it has a gas-conduit 228 that can lead gases from the barrel 94 into the key way 70 via the gas-conduit bore 60. The receiver 12 further has a through-going hole 66 at its upper end 20. The barrel extension 214 has a bore 232 aligned with the hole 66, and a barrel extension pin 230 is inserted in both the bore 232 and the hole 66, thus rotationally fixing the barrel extension 214 relative to the receiver 12. The gas conduit 228 extends through the hole 66 in the receiver 22 and prevents the barrel extension pin 230 from leaving the hole 66.

The automatic rifle 10 has a forend 98 with through-holes 234 that match the forward facing screw holes 92 in the forward extension 48. The forend 98 is attached to the receiver 22 by way of screws (not shown) entering the holes 92 and 234 and engaging the receiver 12.

ITEM LIST

10 automatic rifle
12 unitary receiver
14 bolt way
16 rear end of receiver
18 front end of receiver
20 upper end of receiver
22 lower end of receiver
24 right side of receiver
26 left side of receiver
28 rear opening of receiver
30 extension hole of receiver
32 ejection port
34 magazine well
36 well opening
38 holes for magazine catch
40 trigger housing seat
42 seat opening
46 bore axis
48 forward extension
50 screw hole
52 ledge between screw hole and extension hole
54 blind bore for safety detent spring
56 cut-out for a detent lever
58 holes for safety lever
60 gas-conduit bore
62 first pin hole
64 second pin hole
66 hole for barrel extension pin
70 key way
72 cut out for end of charging handle
74 pivot recess
76 first receiver flange
78 second receiver flange
80 third receiver flange
82 accessory rail
84 pivot-pin holes for grip assembly
86 lock-pin holes for grip assembly
88 beam
90 concave front edge of beam
92 screw holes for forend

94 barrel
96 front end of barrel
98 forend
100 buttstock assembly
102 grip assembly
104 barrel assembly.
106 trigger mechanism
108 safety mechanism
110 bolt assembly.
112 bolt
114 bolt carrier
116 firing pin channel
118 carrier key
120 charging handle
122 buffer
124 action spring
126 buffer tube
128 buttstock adapter
130 buttstock
132 bolt carrier opening
134 adaptor body
136 buffer retainer
138 first locking pin
140 first locking pin hole
142 first through bore in adaptor body
144 first extension pin
146 first adaptor flange
148 second adaptor flange
150 pivot shaft
152 pivot flange
154 second locking pin
156 second through bore in adaptor body
158 second extension pin
160 retainer washer
162 retainer pin
164 retainer pin hole
166 rotation locker
168 trigger
170 hammer
172 disconnector
174 housing
176 pin assembly
178 inner trigger pin
180 inner hammer pin
182 rigid beam
184 grip base
186 pistol grip
188 pivot pin of second pivot
190 lock pin
192 lock pin hole
194 trigger slit
196 upward extending portion
198 pivot pin of first pivot
200 safety lever
202 safety biasing mechanism
204 safety detent
206 safety-detent spring
208 detent lever
210 first recess
212 second recess
214 barrel extension
218 barrel screw
220 radial flange
222 rear portion of the barrel
224 barrel hole
226 gap
228 gas conduit
230 barrel extension pin
232 bore in barrel extension
234 through-holes

The invention claimed is:

1. An automatic rifle, comprising:
a receiver;
a bolt assembly including a bolt carrier;
a trigger mechanism releasably connected to the receiver;
a buttstock assembly;
a barrel assembly; and
a grip assembly;
wherein the receiver houses the bolt assembly and the trigger mechanism; and
wherein the receiver is a unitary body configured to cover the bolt assembly from above so that the bolt assembly is inaccessible from above the receiver; and
wherein the buttstock assembly, the barrel assembly, and the grip assembly are connected to the receiver; and
wherein the receiver includes a front wall, a rear wall, and a pair of opposed side walls defining a magazine well having a magazine opening; and
wherein the trigger mechanism comprises:
a trigger;
a hammer operationally connected to the trigger;
a housing supporting the trigger and the hammer; and
wherein the receiver has a trigger housing seat in which the housing is positioned; and
wherein the trigger housing seat has a lower seat opening through which the housing can be slidably removed in a downward motion.

2. The automatic rifle according to claim 1, wherein the receiver has a front end, a rear end, and a lower end, and wherein the buttstock assembly is connected to the rear end of the receiver, the barrel assembly is connected to the front end of the receiver, the grip assembly is positioned at the lower end of the receiver, and the trigger mechanism is positioned below the bolt assembly.

3. The automatic rifle according to claim 1, wherein the bolt assembly further comprises:
a bolt; and
a firing pin.

4. The automatic rifle according to claim 1, wherein the grip assembly is releasably attached to the receiver, and the grip assembly prevents the housing of the trigger mechanism from being removed through the lower seat opening.

5. The automatic rifle according to claim 1, wherein the grip assembly comprises a first pivot rotationally connecting the grip assembly to the receiver, and wherein the grip assembly has a closed orientation relative to the receiver in which the grip assembly prevents the housing of the trigger mechanism from being removed through the lower seat opening, and an open orientation relative to the receiver at which the grip assembly allows the housing of the trigger mechanism to be removed through the lower seat opening.

6. The automatic rifle according to claim 1, further comprising:
a safety mechanism below the bolt assembly, the safety mechanism comprising:
a safety lever; and
a safety biasing mechanism, wherein the safety biasing mechanism comprises:
a safety detent; and
a safety detent spring operationally connected to the safety detent, whereby the safety detent biases the safety lever;
wherein the safety biasing mechanism as a whole is housed in the receiver; and wherein the safety detent spring is configured to provide a pushing force in a downward direction; and wherein the safety biasing mechanism further comprises:

a detent lever pivotally supported relative to the receiver, whereby the safety detent spring is configured to act on the detent lever, and the detent lever is configured to provide a pushing force in an upwards direction that is transferred to the safety detent.

7. The automatic rifle according to claim 1, wherein the barrel assembly comprises:

a barrel; and a barrel extension supporting the barrel;

wherein the receiver has a front end in which is defined an extension hole, and the barrel extension is at least in part positioned in the extension hole;

wherein the barrel assembly further comprises:

a forward extension fixed relative to the receiver at the front end of the receiver, wherein the forward extension forms a screw hole having a female threading and is aligned with the extension hole of the receiver; and a barrel screw at least in part positioned in the screw hole and having a male threading cooperating with the female threading of the screw hole, the barrel screw engaging the barrel extension so as to press the barrel extension against the receiver.

8. The automatic rifle according to claim 7, wherein the receiver has an upper end and forms an accessory rail extending along at least a portion of the upper end and along the complete length of the forward extension.

9. The automatic rifle according to claim 7, wherein the barrel extension has a radial flange extending outwards, the barrel screw presses against the radial flange, and the radial flange engages the receiver at a distal end of the extension hole.

10. An automatic rifle comprising:

a receiver;

a bolt assembly including a bolt carrier;

a trigger mechanism;

a buttstock assembly;

a barrel assembly; and a grip assembly;

wherein the receiver houses the bolt assembly and the trigger mechanism; and wherein the receiver is a unitary body configured to cover the bolt assembly from above so that the bolt assembly is inaccessible from above the receiver;

wherein the buttstock assembly, the barrel assembly, and the grip assembly are connected to the receiver;

wherein the receiver includes a front wall, a rear wall, a rear opening through which the bolt assembly is slidably removable in a backward motion, and a pair of opposed side walls defining a magazine well having a magazine opening; and wherein the buttstock assembly comprises:

a buffer;

an action spring;

a buffer tube that houses the buffer and the action spring, the buffer tube being configured to receive a rear portion of the bolt carrier during a cycling of the bolt assembly; and a buttstock adapter attached to the buffer tube and to the receiver at the rear opening of the receiver, the buttstock adapter including a bolt carrier opening through which the rear portion of the bolt carrier passes and enters the buffer tube during the cycling of the bolt assembly, wherein the buttstock adapter is configured to prevent the bolt assembly from being removed through the rear opening.

11. The automatic rifle according to claim 10, wherein the bolt carrier opening of the buttstock adapter is a through hole and has a female threading, the buffer tube has a proximal portion positioned in the bolt carrier opening, and the proximal portion has a male threading that cooperates with the female threading of the bolt carrier opening.

12. The automatic rifle according to claim 10, wherein the buttstock adaptor is releasably attached to the receiver.

13. The automatic rifle according to claim 10, wherein the buttstock adaptor further comprises a first pivot rotationally connecting the buttstock assembly to the receiver, wherein the buttstock assembly has a closed orientation relative to the receiver in which the bolt carrier opening is aligned with one of the rear portion of the bolt carrier and the rear opening of the receiver, and an open orientation at which the buttstock adapter allows the bolt assembly to be removed through the rear opening.

14. The automatic rifle according to claim 13, wherein the first pivot engages the receiver at a point below the rear opening of the receiver.

15. The automatic rifle according to claim 14, wherein the first pivot is arranged to rotate the buttstock assembly around an axis that is parallel to a cycling motion of the bolt carrier.

16. The automatic rifle according to claim 14, wherein the first pivot is arranged to rotate the buttstock assembly around an axis that is transverse to a cycling motion of the bolt carrier.

17. The automatic rifle according to claim 16, wherein the grip assembly forms part of the buttstock adapter, and the first pivot is located on, or connected to, the grip assembly.

* * * * *